US012800195B2

(12) United States Patent
Lee et al.

(10) Patent No.: US 12,800,195 B2
(45) Date of Patent: Nov. 17, 2026

(54) REFRIGERATOR

(71) Applicant: SAMSUNG ELECTRONICS CO., LTD., Suwon-si (KR)

(72) Inventors: Jaehyun Lee, Suwon-si (KR); Sungbok Ko, Suwon-si (KR); Myounghun Kim, Suwon-si (KR); Ilsung Bae, Suwon-si (KR); Seokjun Son, Suwon-si (KR); Byungkwan Yang, Suwon-si (KR); Wonjae Yoon, Suwon-si (KR); Insub Lee, Suwon-si (KR); Hyoju Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 99 days.

(21) Appl. No.: 18/824,071

(22) Filed: Sep. 4, 2024

(65) Prior Publication Data

US 2025/0102196 A1 Mar. 27, 2025

Related U.S. Application Data

(63) Continuation of application No. PCT/KR2024/012862, filed on Aug. 28, 2024.

(30) Foreign Application Priority Data

Sep. 22, 2023 (KR) ..... 10-2023-0127486
Jan. 5, 2024 (KR) ..... 10-2024-0002513

(51) Int. Cl.
*F25B 21/02* (2006.01)

(52) U.S. Cl.
CPC ..... *F25B 21/02* (2013.01); *F25B 2321/025* (2013.01)

(58) Field of Classification Search
None
See application file for complete search history.

(56) References Cited

U.S. PATENT DOCUMENTS 3,823,567 A * 7/1974 Corini ..... F25B 21/02 62/3.62
5,522,216 A 6/1996 Park et al.
(Continued)

FOREIGN PATENT DOCUMENTS

JP 6-70296 9/1994
KR 1999-025898 A 4/1999
(Continued)

OTHER PUBLICATIONS

International Search Report issued in International Application No. PCT/KR2024/012862 dated Dec. 16, 2024.
(Continued)

*Primary Examiner* — Marc E Norman
(74) *Attorney, Agent, or Firm* — STAAS & HALSEY LLP

(57) ABSTRACT

A refrigerator may include: a body; a storage compartment inside the body; a door configured to open and close the storage compartment; an evaporator configured to evaporate a refrigerant to generate cold air; an evaporator duct at a rear side of the storage compartment and configured to supply cold air generated by the evaporator to the storage compartment; and a thermoelectric cooling device including a thermoelectric element including a heating portion and a cooling portion, wherein the thermoelectric cooling device is configured to heat air from outside of the body with the heating portion and discharge the air heated by the heating portion to outside of the body, and to cool air from the storage compartment with the cooling portion and supply the cooled air to the storage compartment, and the thermoelectric
(Continued)

cooling device is disposed on an upper side of the storage chamber.

19 Claims, 23 Drawing Sheets

(56) References Cited

U.S. PATENT DOCUMENTS

| | | | | |
|---|---|---|---|---|
| 6,003,319 | A * | 12/1999 | Gilley | F25B 21/02 165/104.21 |
| 6,370,882 | B1 * | 4/2002 | Adamski | F25D 19/00 62/3.6 |
| 6,854,275 | B2 * | 2/2005 | Evans | G11B 17/225 |
| 6,895,762 | B1 * | 5/2005 | Lin | F25B 21/02 62/3.6 |
| 11,060,769 | B2 | 7/2021 | Oh | |
| 11,156,395 | B2 | 10/2021 | Oh et al. | |
| 11,287,193 | B2 | 3/2022 | Lee et al. | |
| 2015/0330678 | A1 * | 11/2015 | Hu | F25C 5/22 62/3.6 |
| 2018/0112895 | A1 * | 4/2018 | Choi | F28D 15/0275 |
| 2021/0247112 | A1 * | 8/2021 | Jeon | F25B 39/02 |
| 2025/0102198 | A1 * | 3/2025 | Han | F25B 21/02 |
| 2025/0102216 | A1 * | 3/2025 | Lee | F25D 21/14 |
| 2025/0224156 | A1 * | 7/2025 | Seo | F25B 21/02 |
| 2025/0224171 | A1 * | 7/2025 | Han | F25D 17/045 |
| 2025/0224172 | A1 * | 7/2025 | Yook | F25D 23/003 |

FOREIGN PATENT DOCUMENTS

| | | | |
|---|---|---|---|
| KR | 10-0235311 | B1 | 12/1999 |
| KR | 10-0235312 | B1 | 12/1999 |
| KR | 2001-0092014 | A | 10/2001 |
| KR | 2002-0000096 | A | 1/2002 |
| KR | 20-0264535 | Y1 | 2/2002 |
| KR | 20-0288419 | Y1 | 9/2002 |
| KR | 10-0369823 | B1 | 1/2003 |
| KR | 10-0399148 | B1 | 9/2003 |
| KR | 10-0483919 | B1 | 4/2005 |
| KR | 10-0501948 | B1 | 7/2005 |
| KR | 10-2006-0107042 | A | 10/2006 |
| KR | 10-2009-0123329 | A | 12/2009 |
| KR | 20-0465443 | Y1 | 2/2013 |
| KR | 10-2014-0046925 | A | 4/2014 |
| KR | 10-2017-0064234 | A | 6/2017 |
| KR | 10-2018-0080652 | | 7/2018 |
| KR | 10-2019-0107896 | | 9/2019 |
| KR | 10-2022-0006285 | A | 1/2022 |
| KR | 10-2416936 | | 7/2022 |
| KR | 10-2427743 | B1 | 8/2022 |
| KR | 10-2531202 | | 5/2023 |

OTHER PUBLICATIONS

Written Opinion issued in International Application No. PCT/KR2024/012862 dated Dec. 16, 2024.

* cited by examiner

REFRIGERATOR

CROSS-REFERENCE TO RELATED APPLICATIONS

This is a continuation application, under 35 U.S.C. § 111(a), of International Application PCT/KR2024/012862, filed Aug. 28, 2024, which claims priority under 35 U.S.C. § 119 to Korean Patent Application No. 10-2023-0127486, filed Sep. 22, 2023 and Korean Patent Application No. 10-2024-0002513, filed Jan. 5, 2024, in the Korean Intellectual Property Office, the disclosures of which are incorporated herein in their entireties by reference.

TECHNICAL FIELD

The present disclosure relates to a refrigerator, and more particularly to a refrigerator including a thermoelectric element for cooling a storage compartment.

BACKGROUND ART

A refrigerator is a home appliance that keeps food fresh by including a main body including a storage compartment and a cold air supply device configured to supply cold air to the storage compartment.

A thermoelectric cooling device that performs heat and cooling functions through the Peltier effect may be used as the cold air supply device for the refrigerator. The thermoelectric cooling device may include a thermoelectric element. The thermoelectric element includes a heating portion formed on one side and a cooling portion formed on the other side, and when a current is applied to the thermoelectric element, heat generation may occur in the heating portion and heat absorption may occur in the cooling portion.

The thermoelectric cooling device may be equipped with a heat dissipation sink, a cooling sink, a heat dissipation fan, a cooling fan, a heat dissipation duct, and a cooling duct, so as to increase the cooling efficiency of the storage compartment through the thermoelectric cooling device.

DISCLOSURE

Technical Problem

The present disclosure is directed to providing a refrigerator including a thermoelectric cooling device using a thermoelectric element.

Further, the present disclosure is directed to providing a refrigerator having increased heat dissipation efficiency of a thermoelectric cooling device.

Further, the present disclosure is directed to providing a refrigerator having increased cooling efficiency of a storage compartment through a thermoelectric cooling device.

Further, the present disclosure is directed to providing a refrigerator capable of utilizing waste heat generated from a thermoelectric cooling device.

Further, the present disclosure is directed to providing a refrigerator capable of facilitating assembly, disassembly, replacement, and repair of a thermoelectric cooling device.

Technical Solution

In one aspect of the present disclosure, a refrigerator may include: a main body; a storage compartment inside the main body; a door configured to open and close the storage compartment; an evaporator configured to evaporate a refrigerant to generate cold air; an evaporator duct at a rear side of the storage compartment and configured to supply cold air generated by the evaporator to the storage compartment; and a thermoelectric cooling device including a thermoelectric element including a heating portion which generates heat and thereby causes air to be heated and a cooling portion which absorbs heat and thereby causes air to be cooled, wherein the thermoelectric cooling device is configured to heat air from an outside of the main body with the heating portion and discharge the air, heated by the heating portion, to the outside of the main body, and to cool air from the storage compartment with the cooling portion and supply the air cooled by the cooling portion to the storage compartment, and the thermoelectric cooling device is disposed on an upper side of the storage chamber.

The heating portion may face above the thermoelectric element and the cooling portion may face below the thermoelectric element.

The thermoelectric cooling device may include a heat dissipation sink. The heat dissipation sink may include a heat dissipation sink base which is in contact with the heating portion, and a plurality of heat dissipation fins protruding from the heat dissipation sink base in a first direction which is perpendicular to an upper surface of the heat dissipation sink base.

The thermoelectric cooling device may include a heat dissipation fan configured to generate a flow of air in a second direction which is parallel to the upper surface of the heat dissipation sink base toward the heat dissipation sink.

The heat dissipation fan may be a centrifugal fan configured to draw air into the centrifugal fan along an axial direction of the centrifugal fan and discharge the flow of air along a radial direction of the centrifugal fan. The heat dissipation sink may be located in the radial direction.

The thermoelectric cooling device may include a fan case in which the heat dissipation fan is accommodated, and which guides the flow of air from the heat dissipation fan toward the heat dissipation sink.

The fan case may include a case bottom on which the heat dissipation fan is rotatably coupled, a case scroll portion extending upward from an edge of the case bottom, and a case guide extending upward from the case bottom and spaced apart from the case scroll portion, and the case bottom, the case scroll portion, and the case guide are configured to guide the flow of air from the heat dissipation fan toward the heat dissipation sink.

The case scroll portion may include a downstream end and an upstream end according to a rotation direction of the heat dissipation fan. A scroll portion opening may be between the downstream end and the upstream end and may be open toward the heat dissipation sink.

The case guide may be configured to guide the flow of air toward the upstream end of the case scroll portion.

The thermoelectric cooling device may include a heat dissipation duct on an upper side of the main body to guide the flow of air to exchange heat with the heat dissipation sink.

The heat dissipation duct may include an outside air intake port to draw air from outside the main body into the heat dissipation duct, and an outside air discharge port to discharge the air, drawn into the heat dissipation duct and which exchanges heat with the heat dissipation sink, toward the outside of the main body.

The heat dissipation duct may include a fan accommodating portion forming a fan accommodating space to accommodate the heat dissipation fan, and a sink accommodating portion forming a sink accommodating space to accommodate the heat dissipation sink.

The fan accommodating space and the sink accommodating space may be located on a horizontal line.

The heat dissipation duct may include an intake duct portion on an upstream side of the fan accommodating portion forming an intake space to guide air, which is drawn from outside the main body into the heat dissipation duct through the outside air intake port, to the fan accommodating space.

The heat dissipation duct may include a discharge duct portion on a downstream side of the sink accommodating portion forming a discharge space to guide air, which exchanges heat with the heat dissipation sink, to the outside air discharge port.

Another aspect of the present disclosure provides a refrigerator including a main body including an upper wall, a lower wall, a left wall, a right wall, and a rear wall; a storage compartment formed inside the main body; a door configured to open and close the storage compartment; a thermoelectric element including a heating portion and a cooling portion, and provided on the upper wall to allow the heating portion to face above the thermoelectric element and to allow the cooling portion to face below the thermoelectric element; a heat dissipation sink including a heat dissipation sink base in contact with the heating portion; and a plurality of heat dissipation fins provided to protrude in a first direction perpendicular to an upper surface of the heat dissipation sink base and provided to extend in a second direction parallel to the upper surface of the heat dissipation sink base; a heat dissipation fan provided on the upper wall to blow air in the second direction toward the plurality of heat dissipation fins; and a heat dissipation duct provided on the upper wall to guide air flowing by the heat dissipation fan.

The heat dissipation fan may be a centrifugal fan configured to draw air in an axial direction and discharge the air to radial directions. The heat dissipation fan may be provided on an upper surface of the main body to allow a rotating shaft of the heat dissipation fan to be perpendicular to the upper surface of the main body and to allow the heat dissipation sink to be located in one radial direction of the heat dissipation fan.

The heat dissipation duct may include a sink accommodating portion provided to form a sink accommodating space provided to accommodate the heat dissipating sink. The sink accommodating space may be formed on a lower surface of the sink accommodating portion.

The heat dissipation duct may include a channel blocking protrusion protruding from the lower surface of the sink accommodating portion to be disposed on a heat dissipation channel that is wider than other heat dissipation channels among heat dissipation channels formed between the plurality of heat dissipation fins.

Another aspect of the present disclosure provides a refrigerator including a main body including an upper wall, a lower wall, a left wall, a right wall, and a rear wall; a storage compartment formed inside the main body; a door configured to open and close the storage compartment; a thermoelectric element including a heating portion and a cooling portion, and provided on the upper wall to allow the heating portion to face above the thermoelectric element and to allow the cooling portion to face below the thermoelectric element; a heat dissipation sink provided to be in contact with the heating portion; a heat dissipation fan configured to generate a flow of air; and a heat dissipation duct including an outside air intake port provided to draw air outside the main body; and an outside air discharge port provided to discharge air, which exchanges heat with the heat dissipation sink, toward the outside of the main body.

Advantageous Effects

Heat dissipation efficiency of a thermoelectric cooling device may be increased.

Further, cooling efficiency of a thermoelectric cooling device may be increased through a natural convection phenomenon of heat.

Further, energy consumption may be reduced by utilizing waste heat generated from a thermoelectric cooling device.

Further, it is possible to facilitate assembly, disassembly, replacement, and repair of a thermoelectric cooling device.

MODES OF THE INVENTION

Figure 1:
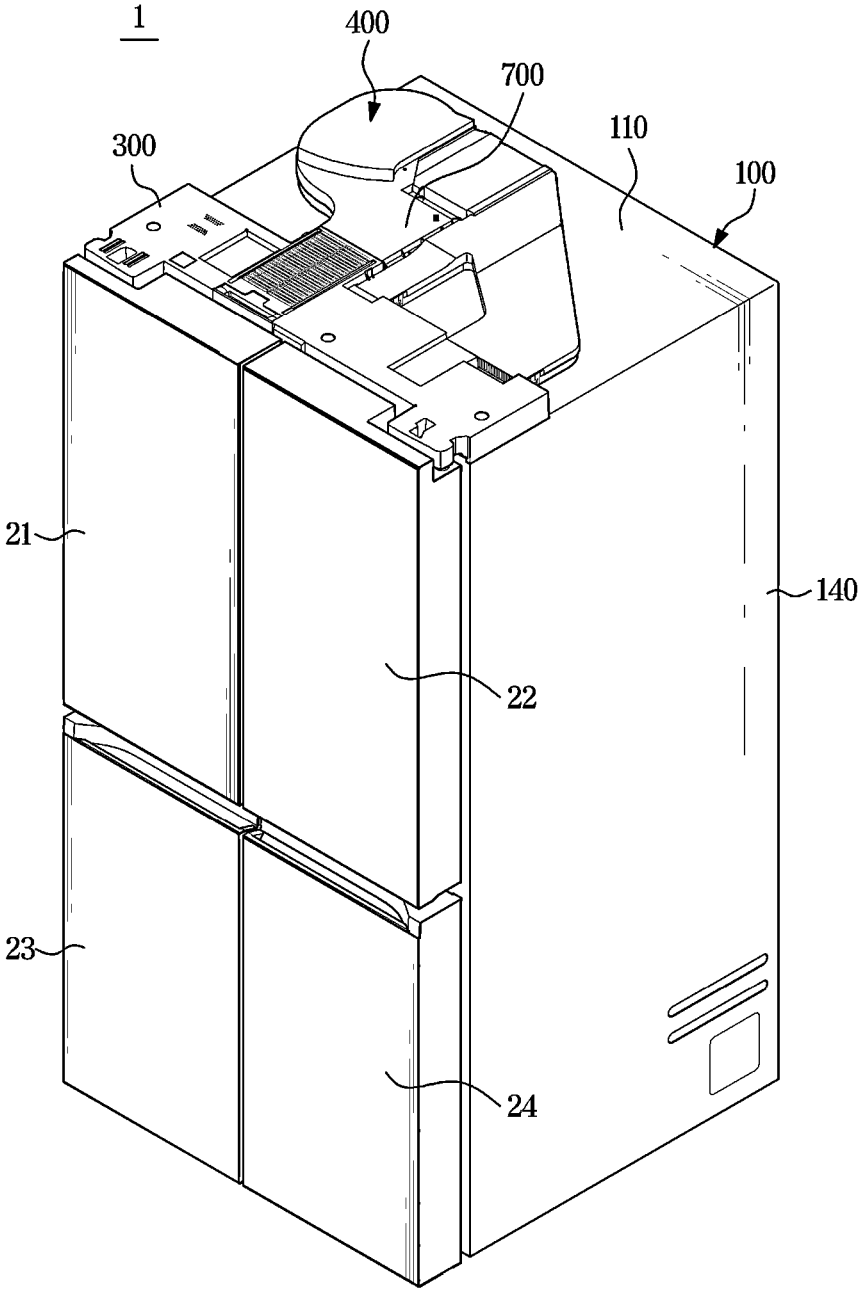
FIG. 1 is a view illustrating a refrigerator according to one embodiment of the present disclosure.

Various embodiments of the present document and terms used therein are not intended to limit the technical features described in this document to specific embodiments, and should be understood to include various modifications, equivalents, or substitutes of the corresponding embodiments.

In connection with the description of the drawings, similar reference numerals may be used for similar or related components.

The singular form of a noun corresponding to an item may include one or a plurality of the items unless clearly indicated otherwise in a related context.

In this document, phrases, such as "A or B", "at least one of A and B", "at least one of A or B," "A, B or C," "at least one of A, B and C," and "at least one of A, B, or C", may include any one or all possible combinations of items listed together in the corresponding phrase among the phrases.

As used herein, the term "and/or" includes any and all combinations of one or more of associated listed items.

Terms such as "1st", "2nd", "primary" or "secondary" may be used simply to distinguish a component from other components, without limiting the component in other aspects (e.g., importance or order).

When a component (e.g., a first component) is referred to as "coupled" or "connected" to another component (e.g., a second component), with or without the terms "functionally" or "communicatively," it may refer to that the component may be connected to another component directly (e.g., wired), wirelessly, or through a third component.

Further, as used in the disclosure, the terms "front", "rear", "top", "bottom", "side", "left", "right", "upper", "lower", and the like are defined with reference to the drawings, and are not intended to limit the shape and position of each component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that when a certain component is referred to as being "connected to", "coupled to", "supported by" or "in contact with" another component, it can be directly or indirectly connected to, coupled to, supported by, or in contact with the other component. When a component is indirectly connected to, coupled to, supported by, or in contact with another component, it may be connected to, coupled to, supported by, or in contact with the other component through a third component.

It will also be understood that when a component is referred to as being "on" or "over" another component, it can be directly on the other component or intervening components may also be present.

A refrigerator according to an embodiment of the disclosure may include a main body.

The main body may include an insulation. The insulation may insulate inside of the storage compartment from outside of the storage compartment to maintain inside temperature of the storage compartment at appropriate temperature without being influenced by an external environment of the storage compartment. According to an embodiment of the disclosure, the insulation may include a foaming insulation. According to an embodiment of the disclosure, the insulation may include a vacuum insulation in addition to a foaming insulation, or may be configured only with a vacuum insulation instead of a forming insulation.

The "storage compartment" may include a space defined by the inner case. The storage compartment may further include the inner case defining the space. One side of the storage compartment may open to enable a user to put food in or take food out. The storage compartment may store "food" therein. The food may include victual which humans eat and drink, and specifically, the food may include meat, fish, seafood, fruits, vegetables, water, ice, drinks, kimchi, alcoholic beverages such as wine, etc. However, medicines or cosmetics, as well as food, may be stored in the storage compartment, and goods that may be stored in the storage compartment are not limited.

The refrigerator may include one or more storage compartments. In a case in which two or more storage compartments are formed in the refrigerator, the respective storage compartments may have different purposes of use, and may be maintained at different temperature. To this end, the storage compartments may be partitioned by a partition wall including an insulation. According to an embodiment of the disclosure, the partition may be one portion of the main body. According to an embodiment of the disclosure, the partition may be provided independently from the main body and then assembled into the main body.

The storage compartment may be maintained within an appropriate temperature range according to a purpose of use, and include a "refrigerating compartment", a "freezing compartment", and a "temperature conversion compartment" according to purposes of use and/or temperature ranges. The refrigerating compartment may be maintained at appropriate temperature to keep food refrigerating, and the freezing compartment may be maintained at appropriate temperature to keep food frozen. The "refrigerating" may be keeping food cold without freezing the food, and for example, the refrigerating compartment may be maintained within a range of 0 degrees Celsius to 7 degrees Celsius. The "freezing" may be freezing food or keeping food frozen, and for example, the freezing compartment may be maintained within a range of −20 degrees Celsius to −1 degrees Celsius. The temperature conversion compartment may be used as any one of a refrigerating compartment or a freezing compartment according to or regardless of a user's selection. According to an embodiment of the disclosure, an area of the storage compartment may be used as a refrigerating compartment and the remaining area of the storage compartment may be used as a freezing compartment.

The storage compartment may also be called various other terms, such as "vegetable compartment", "freshness compartment", "cooling compartment", and "ice-making compartment", in addition to "refrigerating compartment", "freezing compartment", and "temperature conversion compartment", and the terms, such as "refrigerating compartment", "freezing compartment", "temperature conversion compartment", etc., as used below need to be understood to represent storage compartments having the corresponding purposes of use and the corresponding temperature ranges.

The refrigerator according to an embodiment of the disclosure may include at least one door configured to open or close the open side of the storage compartment. The respective doors may be provided to open and close one or more storage compartments, or a single door may be provided to open and close a plurality of storage compartments. The door may be rotatably or slidably mounted on the front of the main body.

The "door" may seal the storage compartment in a closed state. The door may include an insulation, like the main body, to insulate the storage compartment in the closed state.

According to an embodiment, the door may include an outer door plate forming the front surface of the door, an inner door plate forming the rear surface of the door and facing the storage compartment, an upper cap, a lower cap, and a door insulation provided therein.

A gasket may be provided on the edge of the inner door plate to seal the storage compartment by coming into close contact with the front surface of the main body when the door is closed. The inner door plate may include a dyke that protrudes rearward to allow a door basket for storing items to be fitted.

According to an embodiment, the door may include a door body and a front panel that is detachably coupled to the front of the door body and forms the front surface of the door. The door body may include an outer door plate that forms the front surface of the door body, an inner door plate that forms the rear surface of the door body and faces the storage compartment, an upper cap, a lower cap, and a door insulator provided therein.

The refrigerator may be classified as French Door Type, Side-by-side Type, Bottom Mounted Freezer (BMF), Top Mounted Freezer (TMF), or One Door Refrigerator depending on the arrangement of the doors and the storage compartments.

The refrigerator according to an embodiment of the disclosure may include a cold air supply device for supplying cold air to the storage compartment.

The "cold air supply device" may include a machine, an apparatus, an electronic device, and/or a combination system thereof, capable of generating cold air and guiding the cool air to cool the storage compartment.

According to an embodiment of the disclosure, the cold air supply device may generate cold air through a cooling cycle including compression, condensation, expansion, and evaporation processes of refrigerants. To this end, the cold air supply device may include a cooling cycle device having a compressor, a condenser, an expander, and an evaporator to drive the cooling cycle. According to an embodiment of the disclosure, the cold air supply device may include a semiconductor such as a thermoelectric element. The thermoelectric element may cool the storage compartment by heating and cooling actions through the Peltier effect.

The refrigerator according to an embodiment of the disclosure may include a machine compartment where at least some components belonging to the cold air supply device are installed.

The "machine compartment" may be partitioned and insulated from the storage compartment to prevent heat generated from the components installed in the machine compartment from being transferred to the storage compartment. To dissipate heat from the components installed inside the machine compartment, the machine compartment may communicate with outside of the main body.

The refrigerator according to an embodiment of the disclosure may include a dispenser provided on the door to provide water and/or ice. The dispenser may be provided on the door to allow access by the user without opening the door.

The refrigerator according to an embodiment of the disclosure may include an ice-making device that produces ice. The ice-making device may include an ice-making tray that stores water, an ice-moving device that separates ice from the ice-making tray, and an ice-bucket that stores ice generated in the ice-making tray.

The refrigerator according to an embodiment of the disclosure may include a controller for controlling the refrigerator.

The "controller" may include a memory for storing and/or memorizing data and/or programs for controlling the refrigerator, and a processor for outputting control signals for controlling the cold air supply device, etc. according to the programs and/or data memorized in the memory.

The memory may store or record various information, data, commands, programs, and the like necessary for operations of the refrigerator. The memory may store temporary data generated while generating control signals for controlling components included in the refrigerator. The memory may include at least one of volatile memory or non-volatile memory, or a combination thereof.

The processor may control the overall operation of the refrigerator. The processor may control the components of the refrigerator by executing programs stored in memory. The processor may include a separate neural processing unit (NPU) that performs an operation of an artificial intelligence (AI) model. In addition, the processor may include a central processing unit (CPU), a graphics processor (GPU), and the like. The processor may generate a control signal to control the operation of the cold air supply device. For example, the processor may receive temperature information of the storage compartment from a temperature sensor, and generate a cooling control signal for controlling an operation of the cold air supply device based on the temperature information of the storage compartment.

Furthermore, the processor may process a user input of a user interface and control an operation of the user interface according to the programs and/or data memorized/stored in the memory. The user interface may be provided using an input interface and an output interface. The processor may receive the user input from the user interface. In addition, the processor may transmit a display control signal and image data for displaying an image on the user interface to the user interface in response to the user input.

The processor and memory may be provided integrally or may be provided separately. The processor may include one or more processors. For example, the processor may include a main processor and at least one sub-processor. The memory may include one or more memories.

The refrigerator according to an embodiment of the disclosure may include a processor and a memory for controlling all the components included in the refrigerator, and may include a plurality of processors and a plurality of memories for individually controlling the components of the refrigerator. For example, the refrigerator may include a processor and a memory for controlling the operation of the cold air supply device according to an output of the temperature sensor. In addition, the refrigerator may be separately equipped with a processor and a memory for controlling the operation of the user interface according to the user input.

A communication module may communicate with external devices, such as servers, mobile devices, and other home appliances via a nearby access point (AP). The AP may connect a local area network (LAN) to which a refrigerator or a user device is connected to a wide area network (WAN) to which a server is connected. The refrigerator or the user device may be connected to the server via the WAN.

The input interface may include keys, a touch screen, a microphone, and the like. The input interface may receive the user input and pass the received user input to the processor.

The output interface may include a display, a speaker, and the like. The output interface may output various notifications, messages, information, and the like generated by the processor.

Hereinafter exemplary embodiments of the present disclosure will be described in detail with reference to the accompanying drawings.

Figure 2:
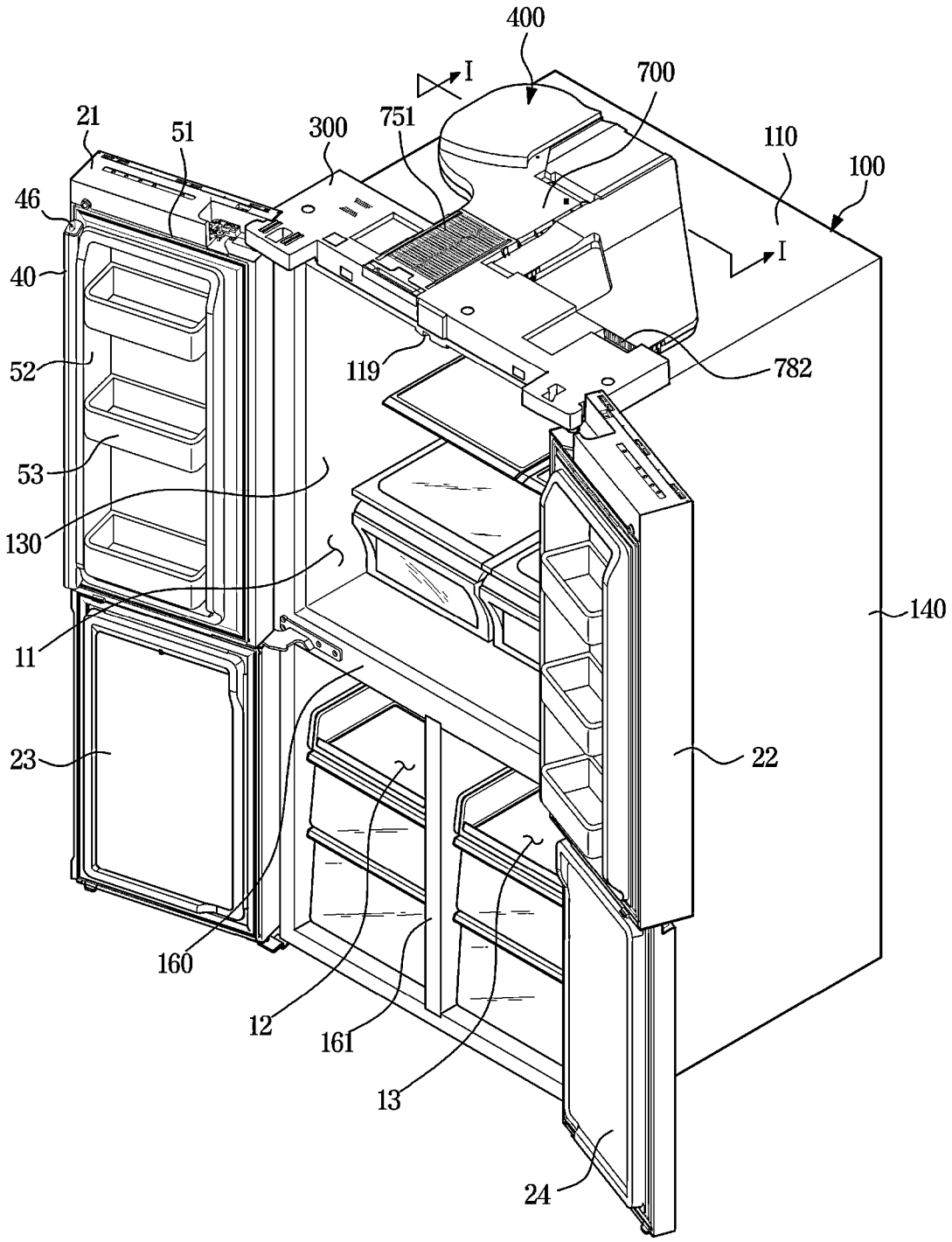
FIG. 2 is a view illustrating a state in which doors of the refrigerator according to one embodiment of the present disclosure are open.
Figure 3:
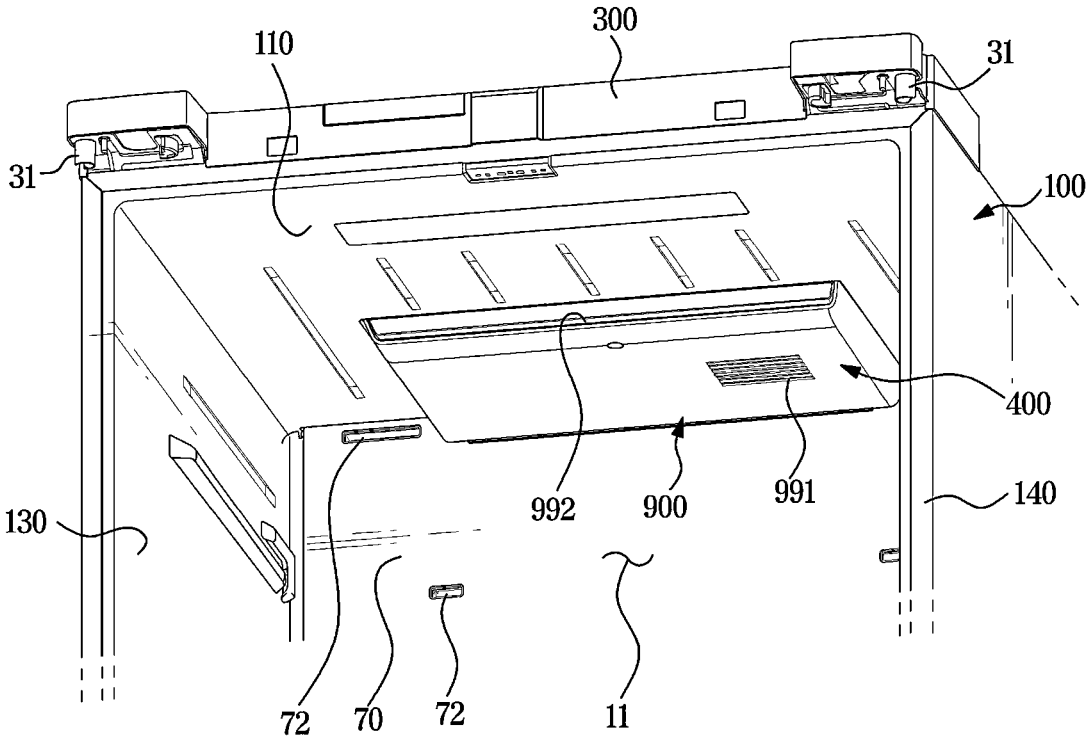
FIG. 3 is a bottom view of an upper portion of a storage compartment of the refrigerator according to one embodiment of the present disclosure.
Figure 4:
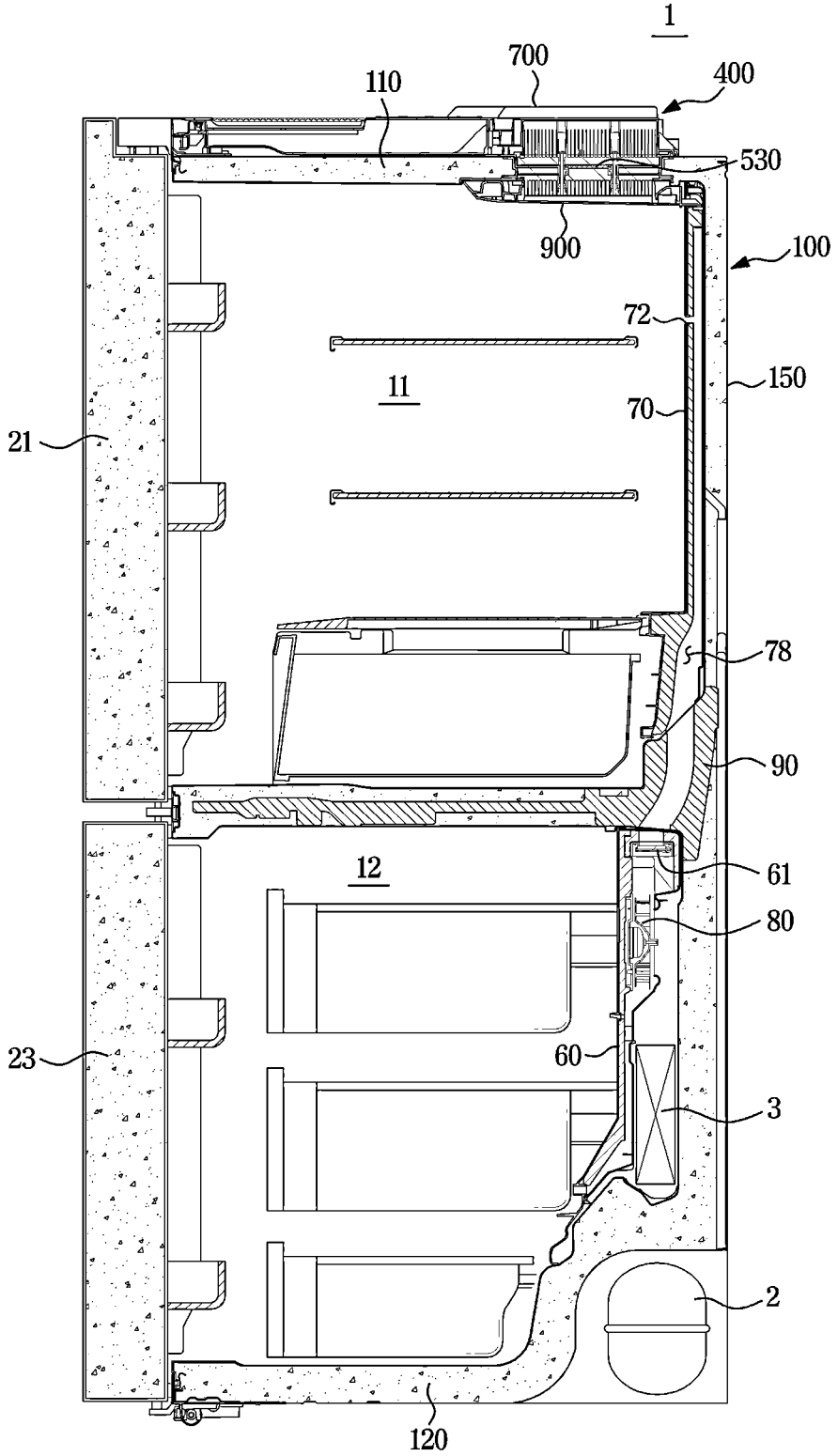
FIG. 4 is a schematic side cross-sectional view of the refrigerator according to one embodiment of the present disclosure.
Figure 5:
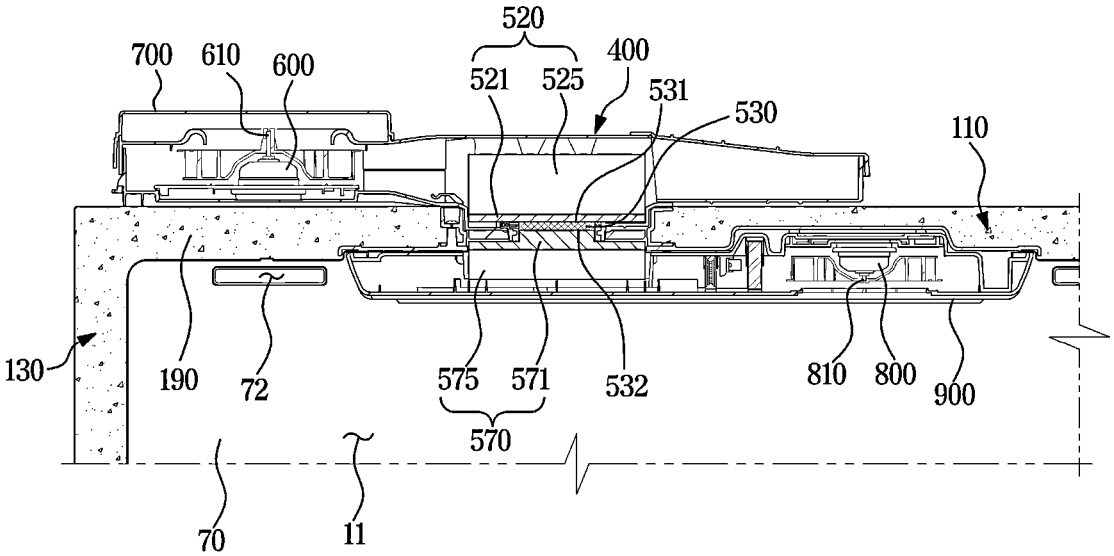
FIG. 5 is a cross-sectional view taken along line I-I of FIG. 2.

FIG. 1 is a view illustrating a refrigerator according to one embodiment of the present disclosure. FIG. 2 is a view illustrating a state in which doors of the refrigerator according to one embodiment of the present disclosure are open. FIG. 3 is a bottom view of an upper portion of a storage compartment of the refrigerator according to one embodiment of the present disclosure. FIG. 4 is a schematic side cross-sectional view of the refrigerator according to one embodiment of the present disclosure. FIG. 5 is a cross-sectional view taken along line I-I of FIG. 2

Referring to FIGS. 1 to 5, a refrigerator 1 may include a main body 100, storage compartments 11, 12, and 13 formed inside the main body 100, and doors 21, 22, 23, and 24 configured to open and close the storage compartments 11, 12, and 13.

Figure 6:
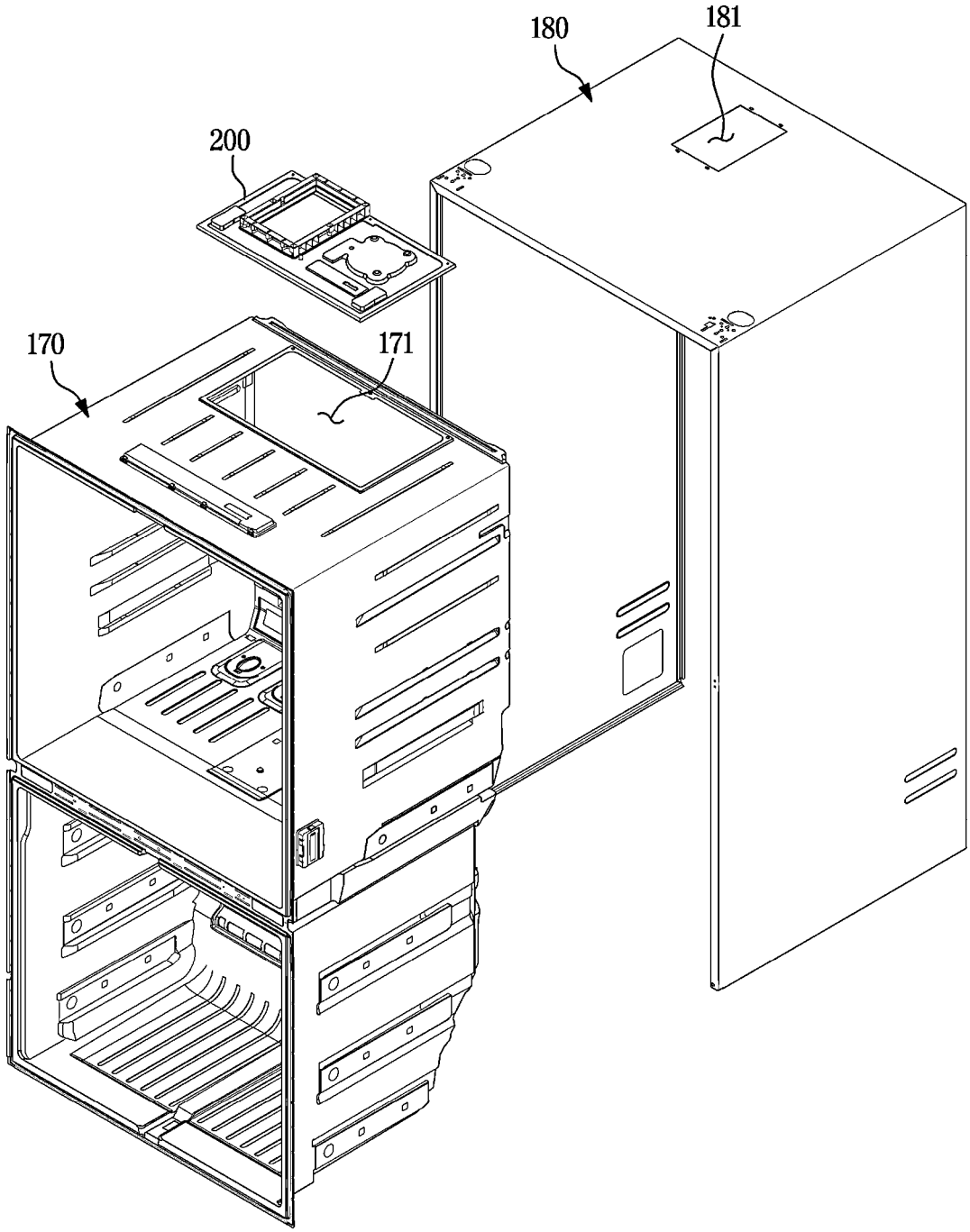
FIG. 6 is a view illustrating an inner case, an outer case, and a connection frame according to one embodiment of the present disclosure.

The main body 100 may include an inner case 170, an outer case 180 coupled to the outside of the inner case 170, and an insulating material 190 disposed between the inner case 170 and the outer case 180 (refer to FIG. 6). The inner case 170 may form the storage compartments 11, 12, and 13, and the outer case 180 may form the exterior of the main body 100.

Further, the main body 100 may include an upper wall 110, a lower wall 120, a left wall 130, a right wall 140, and a rear wall 150. The upper wall 110, the lower wall 120, the left wall 130, the right wall 140, and the rear wall 150 may form an upper surface, a lower surface, a left surface, a right surface and a rear surface of the main body 100, respectively.

The upper wall 110, the lower wall 120, the left wall 130, the right wall 140, and the rear wall 150 may each be formed with the inner case 170, the outer case 180 and the insulating material 190. For example, an upper surface of the upper wall 110 may be formed by the outer case 180, a lower surface of the upper wall 110 may be formed by the inner case 170, and the insulating material 190 may be disposed inside the upper wall 110.

The storage compartments 11, 12, 13 may accommodate goods. The storage compartments 11, 12, and 13 may be formed with an open front side to allow goods to be inserted thereinto or withdrawn therefrom. The main body 100 may include a horizontal partition 160 provided to divide a first storage compartment 11 from a second storage compartment 12 and a third storage compartment 13, and a vertical partition 161 provided to divide the second storage compartment 12 from the third storage compartment 13. The first storage compartment 11 may be provided in an upper portion of the main body 100, and the second storage compartment 12 and the third storage compartment 13 may be provided in a lower portion of the main body 100. The first storage compartment 11 may be a refrigerating compartment, the second storage compartment 12 may be a freezing compartment, and the third storage compartment 13 may be a variable temperature compartment.

The doors 21, 22, 23, and 24 may open and close the storage compartments 11, 12, and 13. A first door 21 and a second door 22 may open and close the first storage compartment 11, a third door 23 may open and close the second storage compartment 12, and a fourth door 24 may open and close the third storage compartment 13. The doors 21, 22, 23, and 24 may be rotatably coupled to the main body 100.

The doors 21, 22, 23, and 24 may be rotatably coupled to the main body 100 by a hinge. For example, the first door 21 and the second door 22 may be rotatably coupled to the main body 100 by a hinge 31 provided in the upper portion of the main body 100 and a hinge provided in a middle portion of the main body 100. The hinge 31 may include a hinge pin that protrudes in a vertical direction to form a rotation axis of the door. The hinge 31 may be covered by a top cover 300 provided to cover a front upper surface of the main body 100.

One of the first door 21 and the second door 22 may be provided with a rotation bar 40 provided to cover a gap formed between the first door 21 and the second door 22 when the first door 21 and the second door 22 are closed. The rotation bar 40 may be rotatably provided on one of the first door 21 and the second door 22. The rotation bar 40 may have a bar shape that is elongated in the vertical direction. The rotation bar 40 may also be referred to as 'pillar', 'mullion', etc.

A guide protrusion 46 may be provided at an upper end of the rotation bar 40, and a rotation guide 119 provided to guide a rotation of the guide protrusion 46 may be provided in the upper portion of the main body 100.

The doors 21, 22, 23, and 24 may include a gasket 51. The gasket 51 may be in close contact with a front surface of the main body 100 when the doors 21, 22, 23, and 24 are closed. The doors 21, 22, 23, and 24 may include a dyke 52 protruding rearward. The dyke 52 may be equipped with a door shelf 53 capable of storing goods. The rotation bar 40 may be rotatably installed on the dyke 52.

The number and arrangement of storage compartments and the number and arrangement of doors are described above, but the number and arrangement of storage compartments and the number and arrangement of doors of the refrigerator according to one embodiment of the present disclosure are not limited thereto.

The refrigerator 1 may include a thermoelectric cooling device 400 configured to cool the storage compartment 11.

Thermoelectric cooling device 400 may be disposed on the upper side of the storage compartment 11 to cool the storage compartment 11. That is, the thermoelectric cooling device may be provided on the upper wall 110 of the main body 100.

The thermoelectric cooling device may include a thermoelectric element 530. The thermoelectric element 530 may be a semiconductor element configured to convert thermal energy into electrical energy using the thermoelectric effect, and may also be referred to as 'thermoelectric semiconductor element', 'Peltier element', etc.

The thermoelectric element 530 includes a heating portion 531 and a cooling portion 532. When a current is applied to the thermoelectric element 530, heat generation may occur in the heating portion 531 and heat absorption may occur in the cooling portion 532. The thermoelectric element 530 may have a thin hexahedral shape. The heating portion 531 may be disposed on one surface of the thermoelectric element 530 and the cooling portion 532 may be disposed on the opposite surface.

The thermoelectric element 530 may be provided on the upper wall 110 in such a way that the heating portion 531 faces above the thermoelectric element 530 and the cooling portion 532 faces below the thermoelectric element 530. That is, the heating portion 531 may face the outside of the main body 100 and the cooling portion 532 may face the inside of the storage compartment 11. Accordingly, air warmed by the heat exchange with the heating portion 531 may be discharged to the outside of the main body 100, and air cooled by the heat exchange with the cooling portion 532 may be supplied to the storage compartment 11.

The thermoelectric cooling device 400 may include a heat dissipation sink 520 in contact with the heating portion 531 to efficiently exchange heat between the heating portion 531 and the air outside the main body 100.

The heat dissipation sink 520 may be located outside the main body 100. The heat dissipation sink 520 may be in contact with the heating portion 531 to absorb heat from the heating portion 531 and emit the heat to the outside of the main body 100. The heat dissipation sink 520 may also be referred to as 'hot sink', 'dissipation heat sink', 'hot heat sink', etc.

The heat dissipation sink 520 may be formed of a metal material with relatively high thermal conductivity. For example, the heat dissipation sink 520 may be formed of aluminum or copper.

The heat dissipation sink 520 may include a heat dissipation sink base 521 in contact with the heating portion 531 and a plurality of heat dissipation fins 525 protruding from the heat dissipation sink base 521 to increase a heat dissipation area. The plurality of heat dissipation fins 525 may protrude upward from the heat dissipation sink base 521.

The thermoelectric cooling device 400 may include a cooling sink 570 in contact with the cooling portion 532 to efficiently exchange heat between the cooling portion 532 and the air inside the storage compartment 11.

The cooling sink 570 may be located inside the storage compartment 11. The cooling sink 570 may cool the storage compartment 11 by absorbing heat from the storage compartment 11 and transferring the heat to the cooling portion 532. The cooling sink 570 may also be referred to as 'cold sink', 'cooling sink', 'cooling heat sink', 'cold heat sink', 'cooling heat sink', etc.

The cooling sink 570 may be formed of a metal material with relatively high thermal conductivity. For example, the cooling sink 570 may be formed of aluminum or copper.

The cooling sink 570 may include a cooling sink base 571 in contact with the cooling portion 532 and a plurality of cooling fins 575 protruding from the cooling sink base 571 to increase a heat transfer area. The plurality of cooling fins 525 may protrude downward from the cooling sink base 571. The cooling sink base 571 and the plurality of cooling fins 575 may be formed integrally with each other.

The thermoelectric cooling device 400 may include a heat dissipation fan 600 configured to move air to efficiently exchange heat between the heat dissipation sink 520 and the air outside the main body 100.

The heat dissipation fan 600 may be configured to blow air toward the heat dissipation sink 520. The heat dissipation fan 600 may be positioned in the horizontal direction of the heat dissipation sink 520. The heat dissipation fan 600 may be provided outside the main body 100. The heat dissipation fan 600 may be provided on the upper side of the upper wall 110.

The heat dissipation fan 600 may be a centrifugal fan configured to draw in air in an axial direction and discharge the drawn air to radial directions. The centrifugal fan may include a blower fan. A rotating shaft 610 of the heat dissipation fan 600 may be disposed perpendicular to the upper surface of the upper wall 110.

The thermoelectric cooling device 400 may include a heat dissipation duct 700 configured to guide air flowing by the heat dissipation fan 600. The heat dissipation duct 700 may draw in air outside the main body 100 and guide the drawn air to exchange heat with the heat dissipation sink 520, and discharge the air, which exchanges heat with the heat dissipation sink 520, back to the outside of the main body 100.

The heat dissipation duct 700 may draw in air in an external space on the upper side of the main body 100. The heat dissipation duct 700 may discharge air, which exchanges heat with the heat dissipation sink 520, to the external space on the upper side of the main body 100. The heat dissipation fan 600 may be located inside the heat dissipation duct 700. The heat dissipation sink 520 may be located inside the heat dissipation duct 700. The heat dissipation duct 700 may be provided on the upper surface of the upper wall 110.

The heat dissipation duct 700 may include an outside air intake port 751 provided to draw in air outside the main body 100 to the inside of the heat dissipation duct 700, and an outside air discharge port 782 provided to discharge air, which exchanges heat with the heat dissipation sink 520, to the outside of the main body 100.

The thermoelectric cooling device 400 may include a cooling fan 800 configured to move air to efficiently exchange heat between the cooling sink 570 and the air inside the storage compartment 11.

The cooling fan 800 may be configured to blow air toward the cooling sink 570. The cooling fan 800 may be located in the horizontal direction of the cooling sink 570. The cooling fan 800 may be provided inside the storage compartment 11. The cooling fan 800 may be provided on the lower side of the upper wall 110.

The cooling fan 800 may be a centrifugal fan configured to draw in air in the axial direction and discharge the drawn air to the radial directions. A rotating shaft 810 of the cooling fan 800 may be disposed perpendicular to the lower surface of the upper wall 110.

The thermoelectric cooling device 400 may include a cooling duct 900 provided to guide air flowing by the cooling fan 800. The cooling duct 700 may draw in air inside the storage compartment 11 and guide the drawn air to exchange heat with the cooling sink 570, and discharge the air, which exchanges heat with the cooling sink 570, back into the storage compartment 11.

The cooling fan 800 may be located inside the cooling duct 900. The cooling sink 570 may be located inside the cooling duct 900. The cooling duct 800 may be provided on the lower surface of the upper wall 110.

The cooling duct 900 may include an inside air intake port 991 provided to draw in air inside the storage compartment 11 to the inside of the cooling duct 900, and an inside air discharge port 992 provided to discharge air, which exchanges heat with the cooling sink 570, to the inside of the storage compartment 11.

Referring to FIG. 4, the refrigerator 1 may include a refrigeration cycle device to cool the storage compartment through a refrigeration cycle. The refrigeration cycle device may include a compressor 2, a condenser (not shown), an expansion device (not shown), and an evaporator 3. The evaporator 3 may be provided at the rear of the storage compartments 12 and 13.

The refrigerator 1 may include evaporator ducts 60 and 70 provided to guide cold air generated in the evaporator 3. A first evaporator duct 60 may be provided at the rear of the second storage compartment 12 and the third storage compartment 13. A second evaporator duct 70 may be provided at the rear of the first storage compartment 11.

Cold air generated in the evaporator 3 may be drawn into the first evaporator duct 60 by an evaporator fan 80. The cold air drawn into the first evaporator duct 60 may be discharged into the second storage compartment 12 or the third storage compartment 13 through a cold air outlet (not shown) formed on the front surface. Additionally, the cold air drawn into the first evaporator duct 60 may be guided to an internal flow path 78 of the second evaporator duct 70. The first evaporator duct 60 may be provided with a damper 61 provided to control the supply of cold air inside the first evaporator duct 60 to the second evaporator duct 70. A connection duct 90 may be provided between the first evaporator duct 60 and the second evaporator duct 70 to connect the first evaporator duct 60 and the second evaporator duct 70.

The cold air introduced into the internal flow path 78 of the second evaporator duct 70 may be supplied to the first storage compartment 11 through the cold air outlet 72 formed on the front surface of the second evaporator duct 70.

However, unlike the above embodiment, cold air generated in the evaporator 3 may be supplied directly to the second evaporator duct 70 without passing through the first evaporator duct 60. Alternatively, a separate evaporator 3 may be provided at the rear of the first storage compartment 11, thereby supplying cold air to the second evaporator duct 70.

As mentioned above, the refrigerator 1 according to one embodiment of the present disclosure may include the thermoelectric cooling device and the refrigeration cycle device for cooling the storage compartment 11. Accordingly, a method of supplying cold air to the storage compartment 11 may include a first method of supplying only cold air generated by the thermoelectric cooling device 400, a second method of supplying only cold generated by the refrigeration cycle device, and a third method of supplying both cold generated by the thermoelectric cooling device and cold air generated by the refrigeration cycle device.

The refrigerator 1 may supply cold air to the storage compartment 11 in an appropriate manner according to external and internal conditions. For example, the refrigerator 1 may cool the storage compartment 11 using one method according to a temperature of an indoor space in which the refrigerator 1 is installed. That is, when an indoor temperature is higher than a predetermined temperature, and cooling by the refrigeration cycle device is more efficient than cooling by the thermoelectric cooling device, the storage compartment 11 may be cooled only with cold generated by the refrigeration cycle device. Conversely, when the indoor temperature is lower than the predetermined temperature and cooling by the thermoelectric cooling device is more efficient than cooling by the refrigeration cycle device, the storage compartment 11 may be cooled only with the cold generated by the thermoelectric cooling device. The refrigerator 1 may only operate the thermoelectric cooling device when it is required to reduce noise. When it is required to rapidly cool the storage compartment 11, the refrigerator 1 may simultaneously supply cold air generated through the thermoelectric cooling device and cold air generated through the refrigeration cycle device to the storage compartment 11.

As mentioned above, according to one embodiment of the present disclosure, the refrigerator may include the thermoelectric cooling device and the refrigeration cycle device, but the present disclosure is not limited thereto. Alternatively, the refrigerator may include only the thermoelectric cooling device 400.

Figure 7:
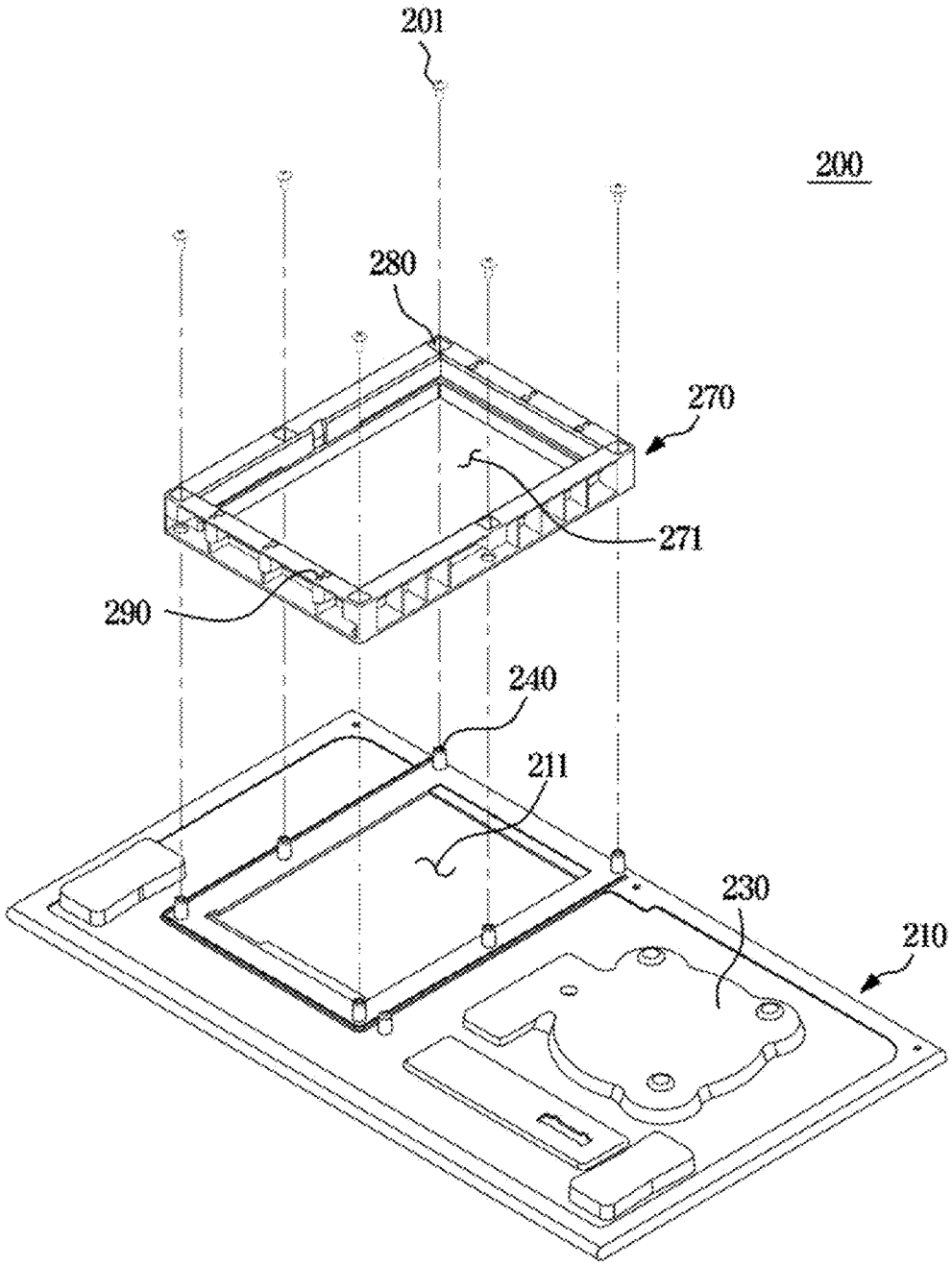
FIG. 7 is a view illustrating the connection frame according to one embodiment of the present disclosure.
Figure 8:
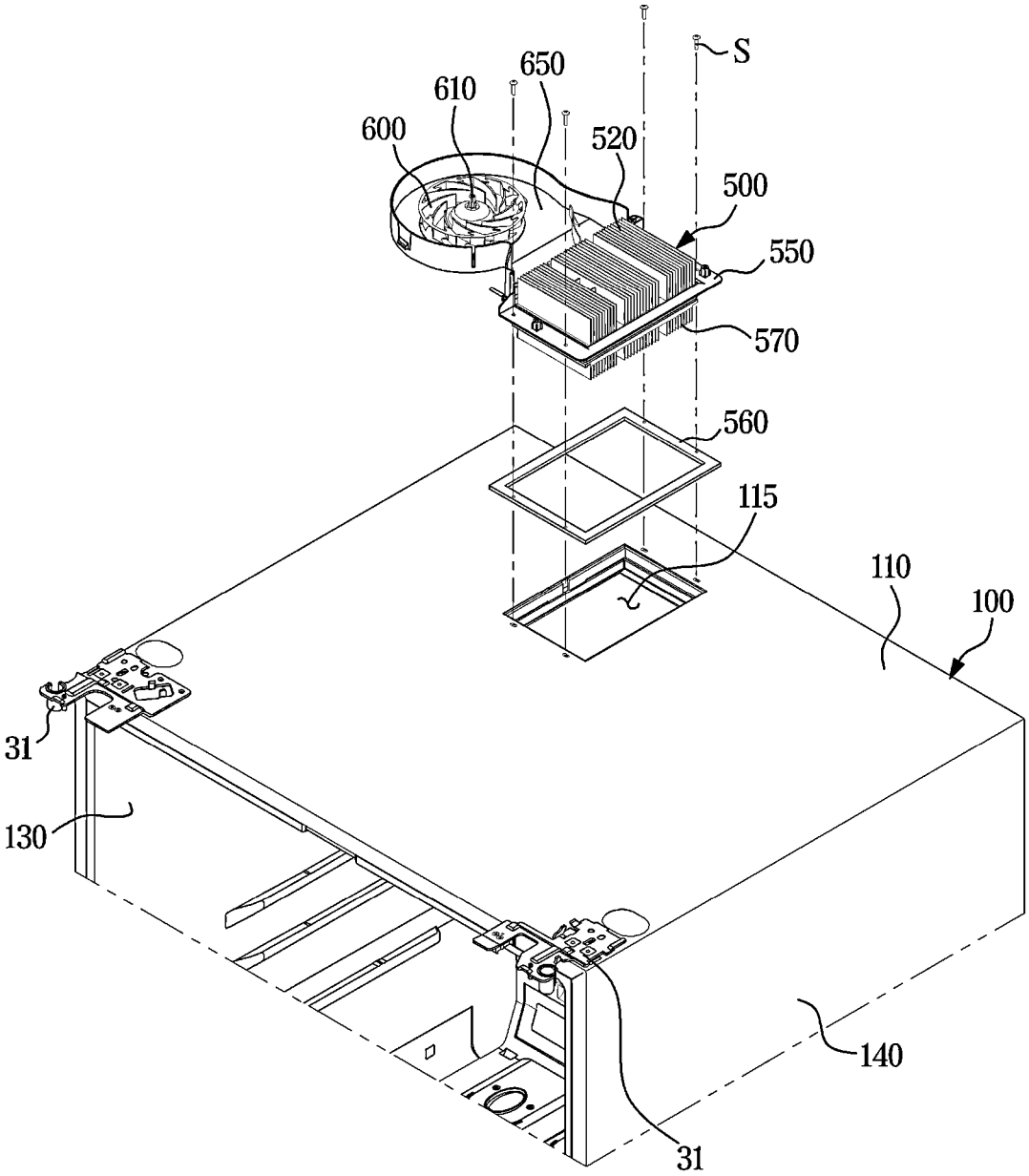
FIG. 8 is a perspective view of a coupling structure between a thermoelectric module and an upper wall of the refrigerator according to one embodiment of the present disclosure.
Figure 9:
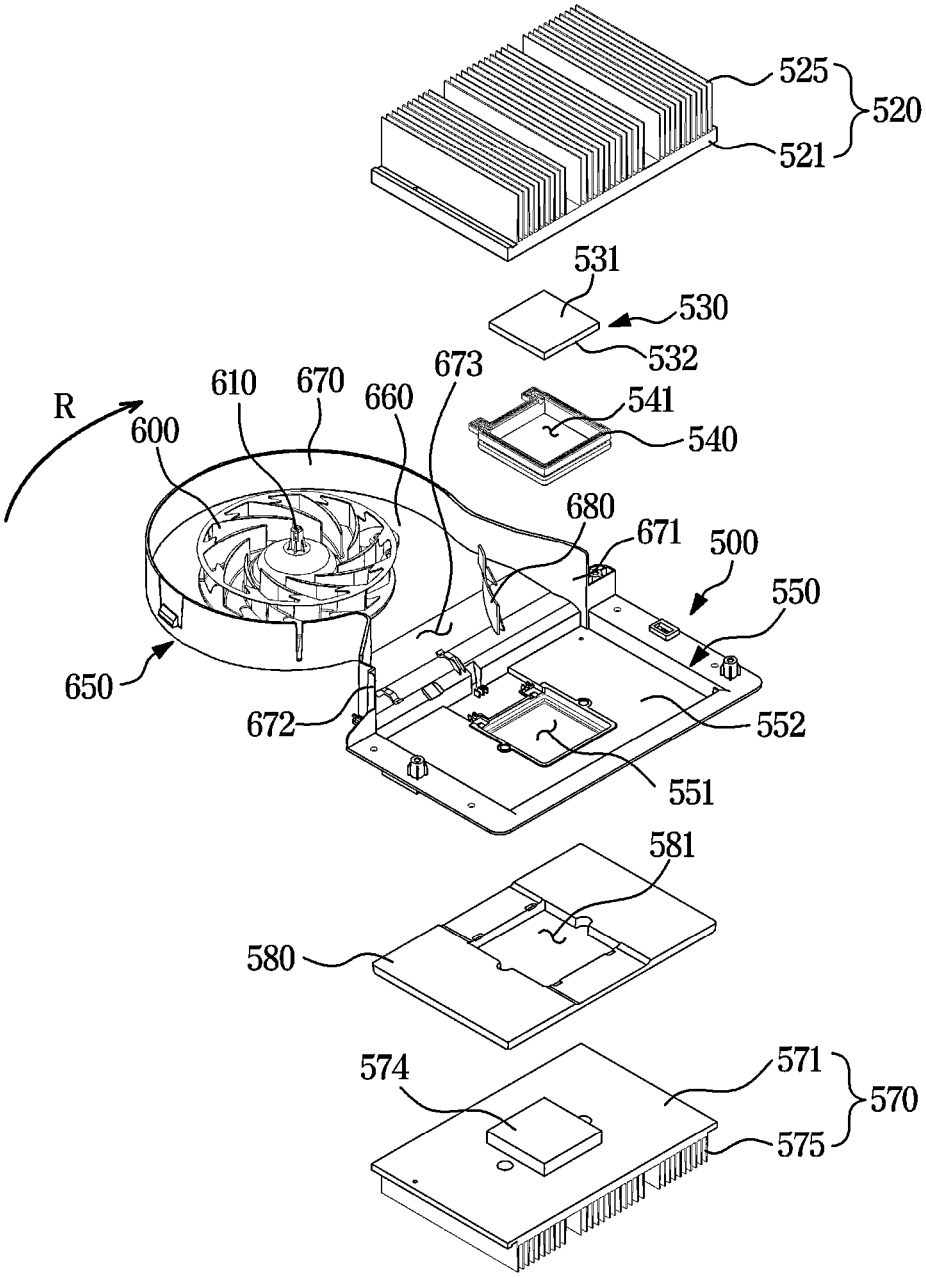
FIG. 9 is an exploded view of a heat dissipation fan and the thermoelectric module according to one embodiment of the present disclosure.
Figure 10:
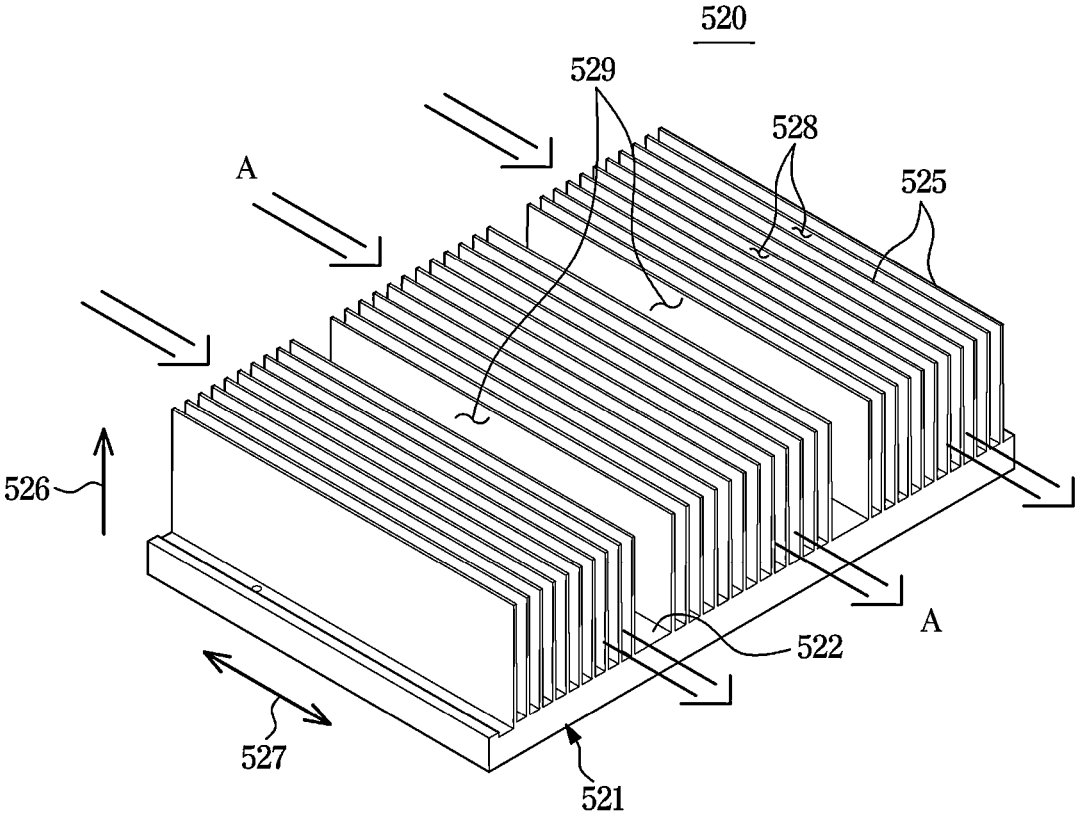
FIG. 10 is a view illustrating a heat dissipation sink according to one embodiment of the present disclosure.
Figure 11:
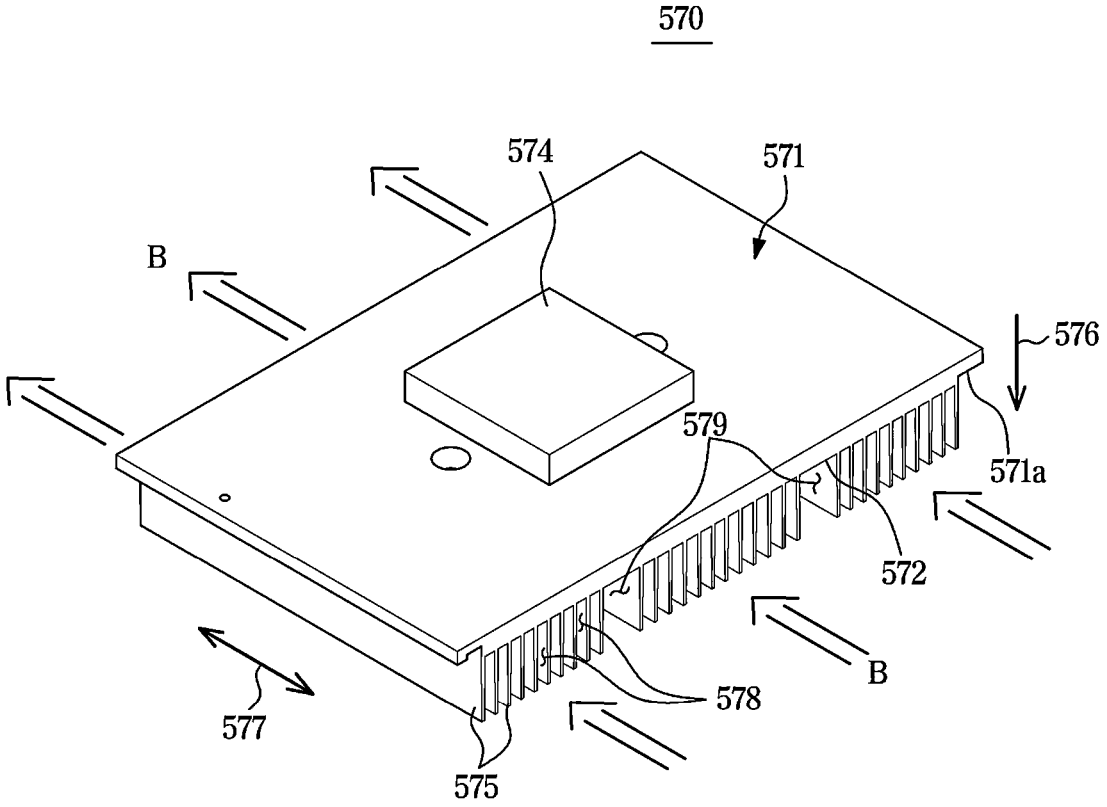
FIG. 11 is a view illustrating a cooling sink according to one embodiment of the present disclosure.

FIG. 6 is a view illustrating an inner case, an outer case, and a connection frame according to one embodiment of the present disclosure. FIG. 7 is a view illustrating the connection frame according to one embodiment of the present disclosure. FIG. 8 is a perspective view of a coupling structure between a thermoelectric module and an upper wall of the refrigerator according to one embodiment of the present disclosure. FIG. 9 is an exploded view of a heat dissipation fan and the thermoelectric module according to one embodiment of the present disclosure. FIG. 10 is a view illustrating a heat dissipation sink according to one embodiment of the present disclosure. FIG. 11 is a view illustrating a cooling sink according to one embodiment of the present disclosure.

A configuration of a thermoelectric module and an installation structure of the thermoelectric module of the thermoelectric cooling device according to one embodiment of the present disclosure will be described with reference to FIGS. 6 to 11.

The main body 100 of the refrigerator 1 may include the inner case 170 forming the storage compartment and the outer case 180 coupled to the outside of the inner case 170. The insulating material 190 provided to insulate the storage compartment may be disposed between the inner case 170 and the outer case 180. The inner case 170 may include an inner case opening 171. The outer case 180 may include an outer case opening 181.

The inner case opening 171 may be formed larger than the outer case opening 181. However, unlike this embodiment, the inner case opening 171 and the outer case opening 181 may be formed to have the same size. In this case, a connection frame 200, which will be described later, may be composed of only a connection frame body 270 without a connection frame base 210.

The main body 100 may include the connection frame 200 disposed between the inner case 170 and the outer case 180 to connect the inner case opening 171 and the outer case opening 181 so as to form a through-hole 115 penetrating the upper wall 110.

One surface of the connection frame 200 may be supported on an inner surface of the inner case 170 (a surface facing the insulating material), and the other surface of the connection frame 200 may be supported on an inner surface of the outer case 180 (a surface facing the insulating material).

In a state in which the connection frame 200 is disposed between the inner case 170 and the outer case 180, an insulating space may be formed by the inner case 170, the outer case 180, and the connection frame 200. By filling and foaming the insulating space with a foamed insulating material, the inner case 170, the outer case 180, and the connection frame 200 may be coupled to each other. The connection frame 200 may be formed of a material with relatively low thermal conductivity. The connection frame 200 may be formed of a resin material.

The connection frame 200 may include the frame base 210 connected to the inner case opening 171, and the frame body 270 protruding from an upper surface of the frame base 210 and connected to the outer case opening 181.

The frame base 210 may have a size corresponding to a size of the inner case opening 171. The frame base 210 may include a frame base opening 211. The frame base opening 211 may have a size corresponding to a size of the outer case opening 181.

The frame body 270 may have a rectangular frame shape with a predetermined thickness. The frame body 270 may include a frame body opening 271. The frame body opening 271 may have a size corresponding to a size of the outer case opening 181. The frame base opening 211 and the frame body opening 271 may form the through-hole 115 of the upper wall 110.

The frame base 210 and the frame body 270 may be provided separately and coupled to each other. The frame base 210 and the frame body 270 may be coupled through a frame coupling member 201. For this, a coupling hole 240 may be formed in the frame base 210 and a coupling hole 280 may be formed in the frame body 270. The frame coupling member 201 may be a coupling mechanical element such as screw, pin, bolt, rivet, etc. However, the frame base 210 and the frame body 270 may be formed integrally with each other.

The frame base 210 may include a base protrusion 230 protruding upward. An accommodating space may be formed on a lower surface of the base protrusion 230 to accommodate a portion of the cooling duct 900.

The thermoelectric cooling device 400 may include the thermoelectric module 500.

The thermoelectric element 530, the heat dissipation sink 520, and the cooling sink 570 described above may be assembled integrally to form the thermoelectric module 500. That is, the thermoelectric module 500 may include the thermoelectric element 530, the heat dissipation sink 520, the cooling sink 570, and a module plate 550.

As illustrated in FIG. 8, the thermoelectric module 500 may be coupled to the upper wall 110 of the main body 100 through a separate coupling member S. The thermoelectric module 500 may penetrate the through-hole 115 of the upper wall 110 to allow the heat dissipation sink 520 to be located outside the main body 100 and to allow the cooling sink 570 to be located inside the storage compartment 11. A sealing member 560 for sealing may be disposed between the module plate 550 of the thermoelectric module 500 and the upper surface of the upper wall 110.

The module plate 550 may serve as a framework for the thermoelectric module. The module plate 550 may be formed of a resin material with relatively low thermal conductivity. The module plate 550 may maintain a gap between the heat dissipation sink 520 and the cooling sink 570 and support the heat dissipation sink 520 and the cooling sink 570. As shown in FIGS. 8 and 9, the module plate 550 may be formed integrally with a fan case 650, which will be described later. However, the module plate 550 may be provided separately from the fan case 650.

The module plate 550 may include a heat dissipation sink support portion 552 provided to support the heat dissipation sink 520.

The module plate 550 may include a module plate opening 551. The thermoelectric element 530 may be disposed inside the module plate opening 551. A vertical length of the module plate opening 551 may be greater than a vertical length of the thermoelectric element 530, and the thermoelectric element 530 may be disposed at an upper end portion of the module plate opening 551. The reason why the thermoelectric element 530 is disposed at the upper end portion inside the module plate opening 551 is that a heat generation amount of the thermoelectric element 530 is generally greater than a heat absorption amount, and it is appropriate that the thermoelectric element 530 is located at the upper end portion of the module plate opening 551, in terms of the heat dissipation of the heating portion 531.

Because the thermoelectric element 530 is disposed on the upper end portion of the module plate opening 551 as mentioned above, the cooling sink 570 may include a cooling conductive portion 574 protruding from the cooling sink base 571 to be in contact with the cooling portion 532 of the thermoelectric element 530.

The thermoelectric module 500 may include an element insulating material 540 provided to insulate the module plate 550 and the thermoelectric element 530. The element insulating material 540 may be disposed in the module plate opening 551 to prevent a side surface of the thermoelectric device 530 from being in contact with the module plate 550. The element insulating material 540 may include an element insulating material opening 541, and the thermoelectric device 530 may be accommodated in the element insulating material opening 541.

The thermoelectric module 500 may include a sink insulating material 580 disposed between the module plate 550 and the cooling sink 570. The sink insulating material 580 may prevent heat from being transferred between the heat dissipation sink 520 and the cooling sink 570 through the module plate 550. The sink insulating material 580 may include a sink insulating material opening 581. However, the sink insulating material 580 may be omitted. In this case, the heat dissipation sink 520 may be supported on the upper surface of the module plate 550 and the cooling sink 570 may be supported on the lower surface of the module plate 550.

Referring to FIGS. 8 to 10, the thermoelectric cooling device 400 may include the fan case 650, in which the heat dissipation fan 600 is installed, and further the fan case 650 may guide air blown by the heat dissipation fan 600. The fan case 650 may be formed integrally with the above-mentioned module plate 550, or may be provided separately.

The fan case 650 may include a case bottom 660 on which the heat dissipation fan 600 is rotatably installed, and a case scroll portion 670 extending upward from an edge of the case bottom 660 to guide air, which is blown by the heat dissipation fan 600, to the heat dissipation sink 520. The heat dissipation fan 600 may be a centrifugal fan and may be installed on the case bottom 660 to allow the rotating shaft 610 to be perpendicular to the case bottom 660. Additionally, the heat dissipation sink 520 may be positioned in one radial direction of the heat dissipation fan 600. With this structure, the overall vertical length of the thermoelectric cooling device 400 may be compact.

The case scroll portion 670 may be formed to surround the heat dissipation fan 600. The case scroll portion 670 may include a scroll portion opening 673 provided to open toward the heat dissipation sink 520. The case scroll portion 670 may include a downstream end 671 with respect to a rotation direction R of the heat dissipation fan 600 and an upstream end 672 with respect to the rotation direction R.

The downstream end 671 and the upstream end 672 may be spaced apart from each other, and the scroll portion opening 673 may be formed between the downstream end 671 and the upstream end 672.

Air blown by the heat dissipation fan 600 may be discharged in the radial directions of the heat dissipation fan 600 and move toward the heat dissipation sink 520 along an inner surface of the case scroll portion 670. Accordingly, the air blown by the heat dissipation fan 600 may flow more to a vicinity of the downstream end 671 of the case scroll portion 670 than a vicinity of the upstream end 672 of the case scroll portion 670.

The fan case 650 may include a case guide 680 provided to guide air that flows from the heat dissipation fan 600 to the vicinity of the downstream end 671 of the case scroll portion 670.

The case guide 680 may protrude upward from the case bottom 660. The case guide 680 may be spaced apart from the case scroll portion 670. The case guide 680 may guide air, which flows to the vicinity of the downstream end 671 of the case scroll portion 670, toward the upstream end 672 of the case scroll portion 670. Accordingly, the air blown from the heat dissipation fan 600 may be evenly distributed to heat dissipation channels 528 of the heat dissipation sink 520 by the case guide 680, and the heat exchange efficiency of the heat dissipation sink 520 may be increased.

Referring to FIG. 10, the plurality of heat dissipation fins 525 may protrude from a upper surface 522 of the heat dissipation sink base 521. The plurality of heat dissipation fins 525 may protrude in a first direction 526 perpendicular to the upper surface 522 of the heat dissipation sink base 521.

The plurality of heat dissipation fins 525 may be formed to extend in a second direction 527 parallel to the upper surface 522 of the heat dissipation sink base 521. The second direction 527 may be perpendicular to the first direction 526. The heat dissipation channels 528 may be formed between a plurality of heat dissipation fins 525 adjacent to each other. The heat dissipation channels 528 may extend in the second direction 527 in the same as the plurality of heat dissipation fins 525. Among the heat dissipation channels 528, some heat dissipation channels 529 may have a larger width than other heat dissipation channels.

Air moving by the heat dissipation fan 600 may pass through the heat dissipation channels 528 and exchange heat with the plurality of heat dissipation fins 525. An airflow (A) flowing by the heat dissipation fan 600 may pass through the heat dissipation channels 528 in a direction parallel to the second direction 527.

Referring to FIG. 11, the plurality of cooling fins 575 may protrude from a lower surface 572 of the cooling sink base 571. The plurality of cooling fins 575 may protrude in the first direction 576 perpendicular to the lower surface 572 of the cooling sink base 571.

The plurality of cooling fins 575 may be formed to extend in the second direction 577 in parallel with the lower surface 572 of the cooling sink base 571. The second direction 577 may be perpendicular to the first direction 576. Cooling channels 578 may be formed between the plurality of cooling fins 575 adjacent to each other. Among the cooling channels 578, some cooling channels 579 may have a larger width than other cooling channels 578.

Air moving by the cooling fan 800 may pass through the cooling channels 578 and exchange heat with the plurality of cooling fins 575. An airflow (B) flowing by the cooling fan 800 may pass through the cooling channels 578 in a direction parallel to the second direction 577.

Figure 12:
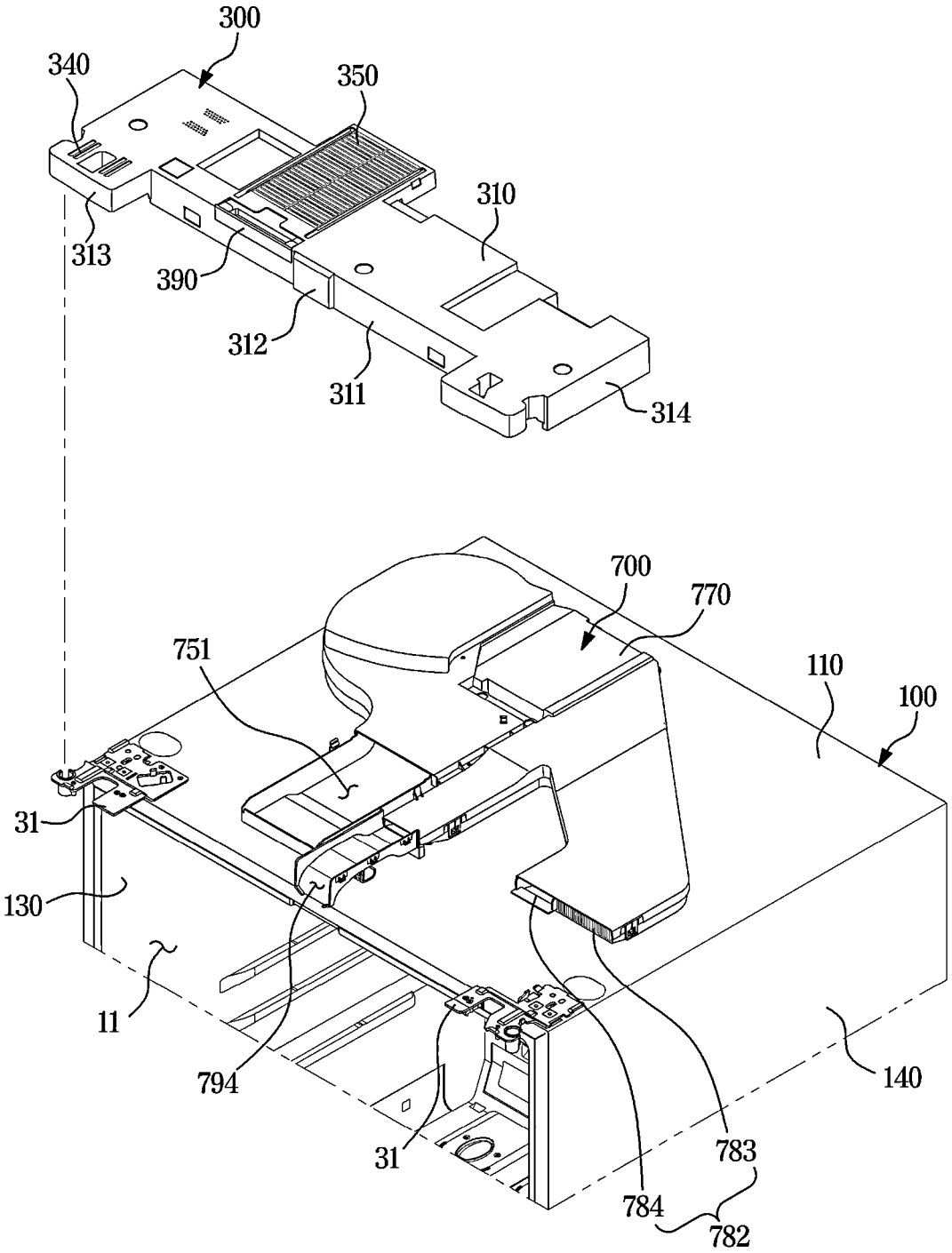
FIG. 12 is a view illustrating a top cover separated from a main body of the refrigerator according to one embodiment of the present disclosure.
Figure 13:
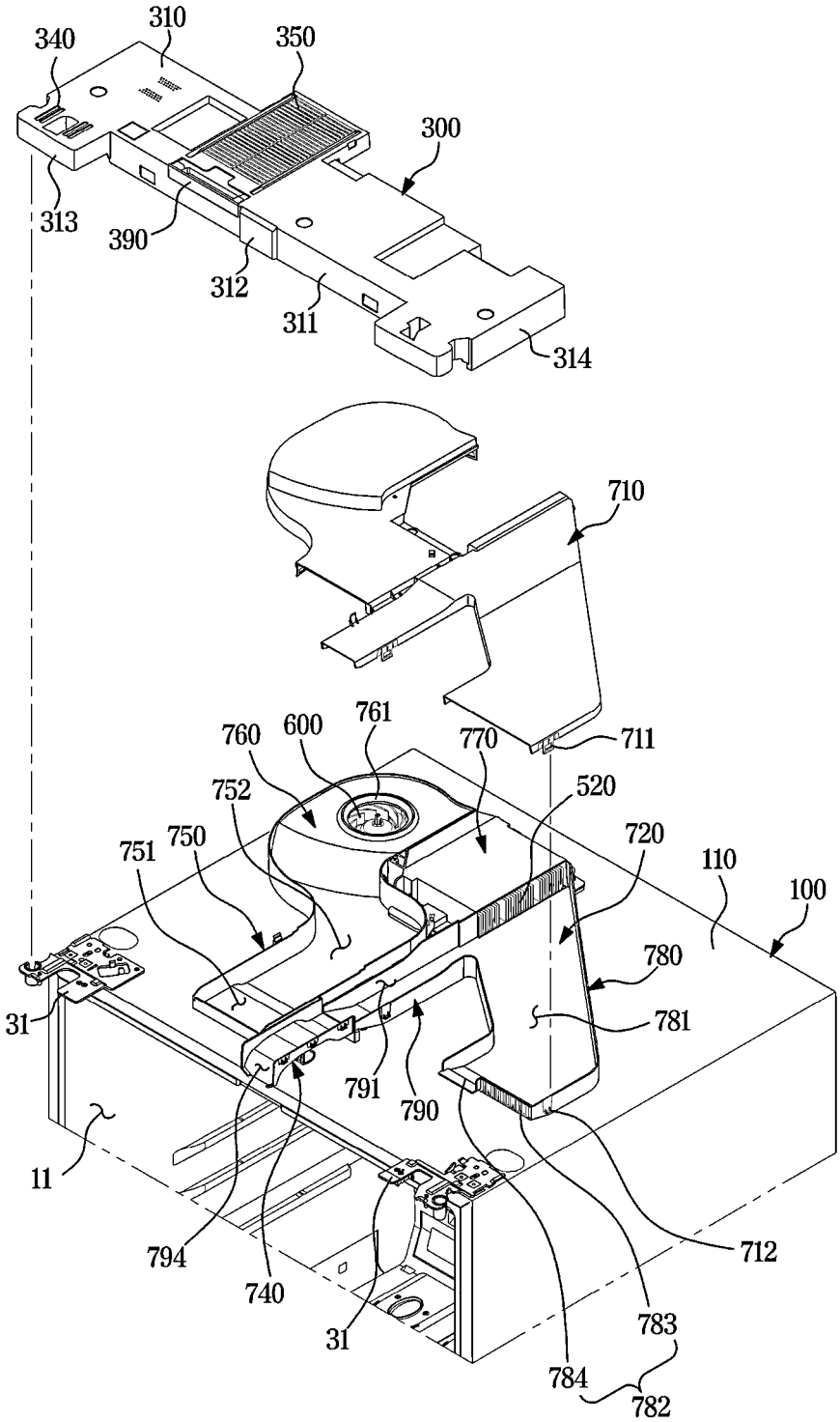
FIG. 13 is a view illustrating the top cover and a heat dissipation duct cover separated from the main body of the refrigerator according to one embodiment of the present disclosure.
Figure 14:
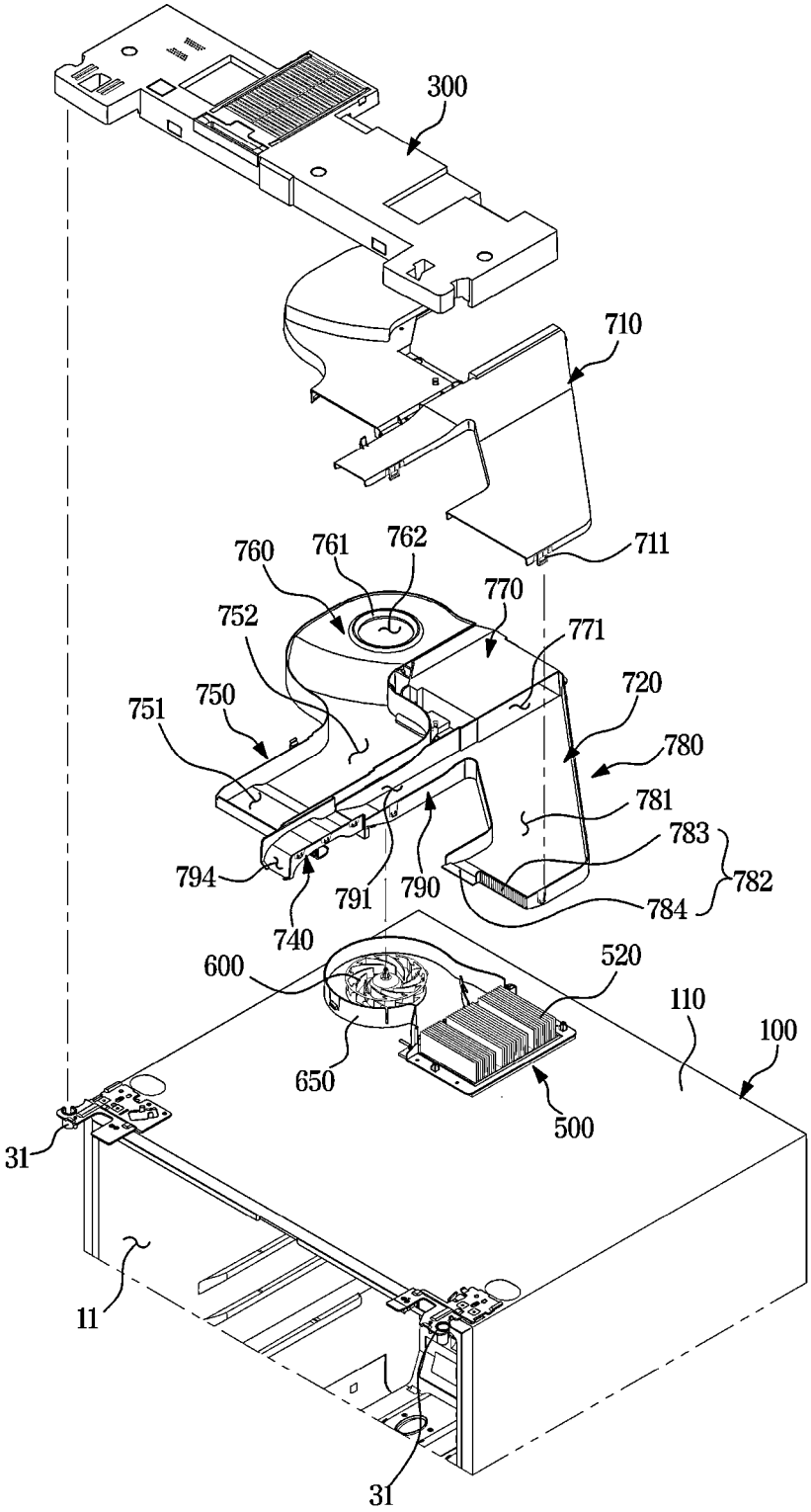
FIG. 14 is a view illustrating the top cover, the heat dissipation duct cover, a heat dissipation duct body, and an extension duct separated from the main body of the refrigerator according to one embodiment of the present disclosure.
Figure 15:
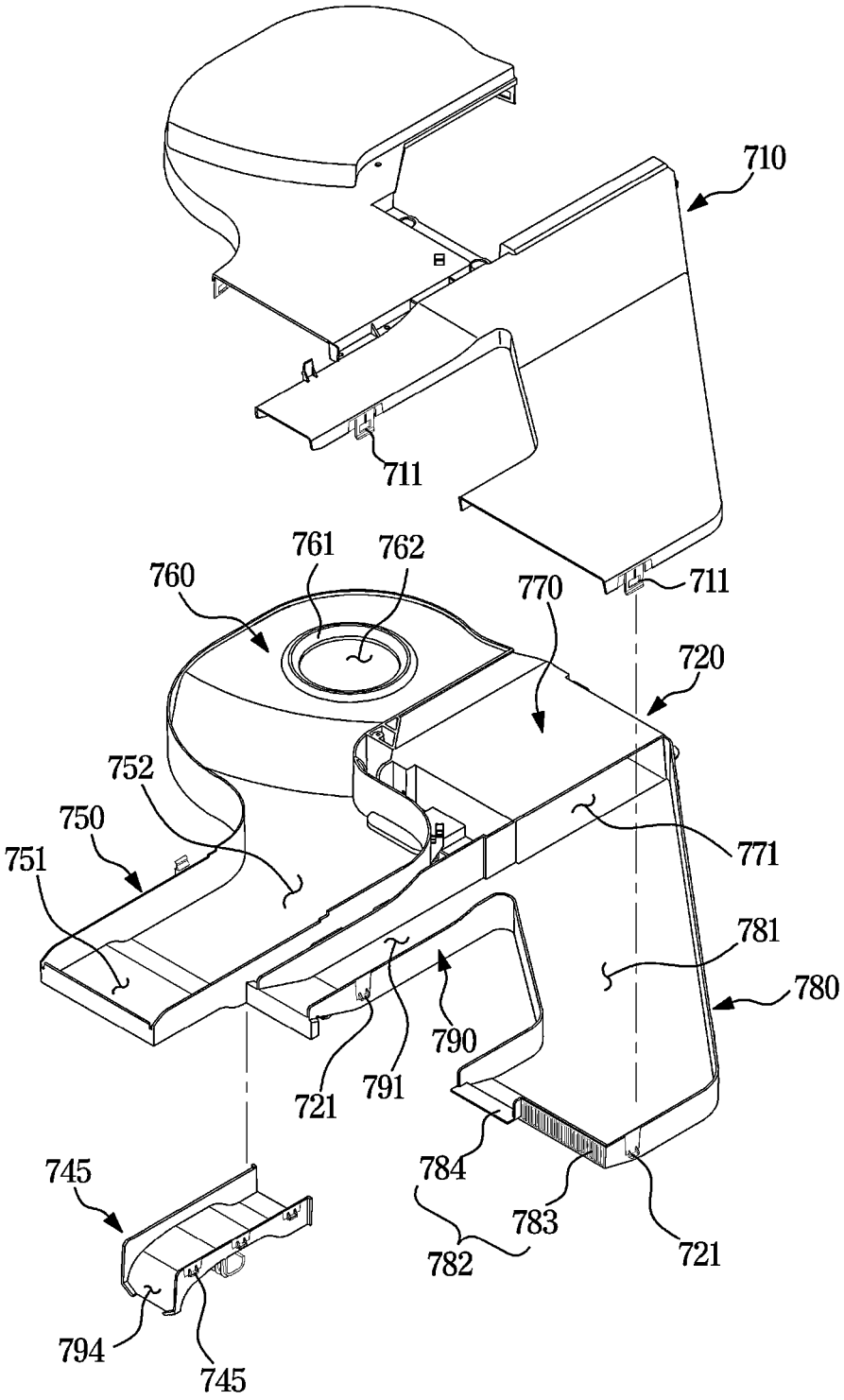
FIG. 15 is an exploded view of the heat dissipation duct according to one embodiment of the present disclosure.
Figure 16:
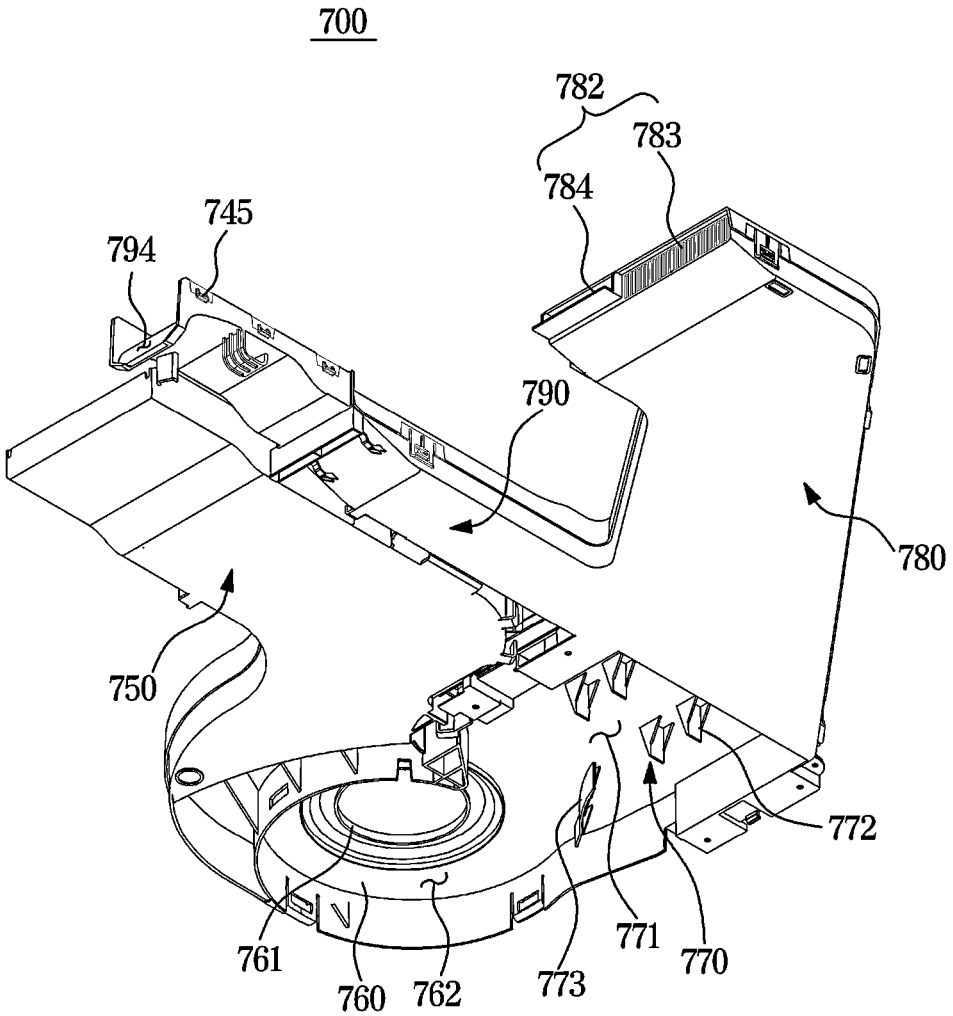
FIG. 16 is a view illustrating a lower surface of the heat dissipation duct according to one embodiment of the present disclosure.
Figure 17:
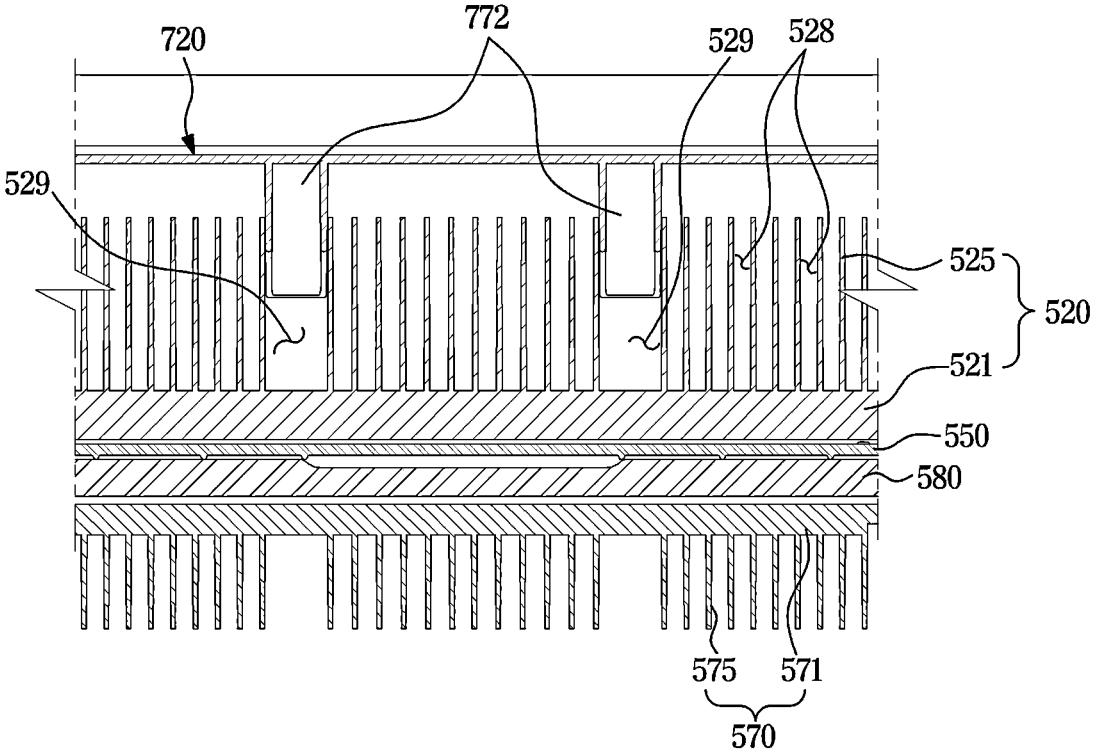
FIG. 17 is an enlarged view of a portion of the heat dissipation duct and the thermoelectric module according to one embodiment of the present disclosure.

FIG. 12 is a view illustrating a top cover separated from a main body of the refrigerator according to one embodiment of the present disclosure. FIG. 13 is a view illustrating the top cover and a heat dissipation duct cover separated from the main body of the refrigerator according to one embodiment of the present disclosure. FIG. 14 is a view illustrating the top cover, the heat dissipation duct cover, a heat dissipation duct body, and an extension duct separated from the main body of the refrigerator according to one embodiment of the present disclosure. FIG. 15 is an exploded view of the heat dissipation duct according to one embodiment of the present disclosure. FIG. 16 is a view illustrating a lower surface of the heat dissipation duct according to one embodiment of the present disclosure. FIG. 17 is an enlarged view of a portion of the heat dissipation duct and the thermoelectric module according to one embodiment of the present disclosure.

The structure of the heat dissipation duct 700 according to one embodiment of the present disclosure will be described with reference to FIGS. 12 to 17.

The refrigerator 1 may include the heat dissipation duct 700 provided on the upper wall 110 and configured to draw in air outside the main body 100 to exchange heat with the heat dissipation sink 520, and to allow the air, which exchanges heat with the heat dissipation sink 520, to be discharged back to the outside of the main body 100.

The heat dissipation duct 700 may include a heat dissipation duct body 720, a heat dissipation duct cover 710, and an extension duct 740.

The heat dissipation duct body 720 may be coupled to the upper surface of the main body 100. The heat dissipation duct body 720 may cover the heat dissipation fan 600 and the heat dissipation sink 520. The outside air intake port 751 may be formed on a front upper surface of the heat dissipation duct body 720, and the outside air intake port 751 may be covered by the top cover 300.

The heat dissipation duct cover 710 may be coupled to an upper portion of the heat dissipation duct body 720 to cover the upper side of the heat dissipation duct body 720. For this, a duct cover coupling portion 711 may be provided on the heat dissipation duct cover 710, and a duct body coupling portion 721 coupled to the duct cover coupling portion 711 may be provided on the heat dissipation duct body 720. The duct cover coupling portion 711 and the duct body coupling portion 721 may be coupled by a hook method or a fitting method.

The extension duct 740 may be provided in front of the heat dissipation duct body 720 to be connected to the heat dissipation duct body 720. As shown in FIG. 15, the extension duct 740 may be provided separately from the heat dissipation duct body 720. Alternatively, the extension duct 740 may be provided integrally with the heat dissipation duct body 720.

The extension duct 740 may be disposed below the top cover 300, and the upper side of the extension duct 740 may be covered by the top cover 300. The extension duct 740 may be coupled to a lower portion of the top cover 300. For this, the extension duct 740 may be provided with an extension duct coupling portion 745, and the top cover 300 may be provided with a top cover coupling portion 380 coupled to the extension duct coupling portion 745. The extension duct coupling portion 745 and the top cover coupling portion 380 may be coupled by a hook method or a fitting method.

The heat dissipation duct 700 may include the outside air intake port 751 provided to draw in air outside the main body. Particularly, the heat dissipation duct body 720 may include the outside air intake port 751.

The outside air intake port 751 may be formed on the upper surface of the heat dissipation duct body 720. The outside air intake port 751 may be located closer to the front surface of the main body 100 than the rear surface of the main body 100. The reason that the outside air intake port 751 is located closer to the front surface of the main body 100 than the rear surface of the main body 100 is to prevent heat, which is generated by the compressor 2 and the condenser located at the rear of the main body 100, from being transmitted through the outside air intake port 751.

The heat dissipation duct 700 may include the outside air discharge ports 782 and 794 provided to discharge air, which exchanges heat with the heat dissipation sink 520, to the outside of the main body 100.

The heat dissipation duct body 720 may include a first outside air discharge port 782 provided to discharge air, which exchanges heat with the heat dissipation sink 520, to the outside of the main body 100. The first outside air discharge port 782 may discharge air, which exchanges heat with the heat dissipation sink 520, toward the external space above the main body 100.

The extension duct 740 may include a second outdoor air discharge port 794 provided to discharge air, which exchanges heat with the heat dissipation sink 520, to the rotation bar 40. As the air, which exchanges heat with the heat dissipation sink 520, is discharged toward the rotation bar 40, it is possible to prevent the dew condensation in the rotation bar 40.

However, the heat dissipation duct 700 does not necessarily include the first outside air discharge port 782 and the second outside air discharge port 794. Further, the second outside air discharge port 794 may be omitted.

The heat dissipation duct 700 may include a fan accommodating portion 760 provided to form a fan accommodating space 762 provided to accommodate the heat dissipating fan 600. Particularly, the heat dissipation duct body 720 may include the fan accommodating portion 760 provided to form the fan accommodating space 762 provided to accommodate the heat dissipating fan 600.

The fan accommodating space 762 may be formed on a lower surface of the fan accommodating portion 760. A lower side of the fan accommodating space 762 may be open and the open lower side of the fan accommodating space 762 may be covered by the fan case 650. The fan accommodating portion 760 may include a fan inlet 761 through which air flows into the fan accommodating space 762. The fan inlet 761 may be formed on an upper side of the fan accommodating space 762.

The heat dissipation duct 700 may include a sink accommodating portion 770 provided to form a sink accommodating space 771 provided to accommodate the heat dissipating sink 520. The sink accommodating space 771 may be formed on a lower surface of the sink accommodating portion 770. A lower side of the sink accommodating space 771 may be open. The open lower side of the sink accommodating space 771 may be covered by the module plate 550. The sink accommodating space 771 may be formed on a downstream side of the fan accommodating space 762.

As illustrated in FIGS. 16 and 17, the sink accommodating portion 770 may include a channel blocking protrusion 772 protruding from the lower surface of the sink accommodating portion 770. The channel blocking protrusion 772 may be disposed in the heat dissipation channel 529 that is wider than the other heat dissipation channels among the heat dissipation channels 528 formed between the plurality of heat dissipation fins 525. The channel blocking protrusion 772 may prevent air from flowing into the wide heat dissipation channel 529 and induce air to flow into other heat dissipation channels 528.

The reason that the channel blocking protrusion 772 is provided in the wide heat dissipation channel 529 is that a flow rate or heat exchange efficiency of air flowing through the wide heat dissipation channel 529 is reduced because a distance between the pair of heat dissipation fins 525 adjacent to the wide heat dissipation channel 529 is long.

As illustrated in FIG. 16, the sink accommodating portion 770 may include a duct guide 773 protruding from the lower surface of the sink accommodating portion 770. The duct guide 773 may have a shape corresponding to the case guide 680 that protrudes above the fan case 650 and may be provided at a position corresponding to the case guide 680. That is, a lower surface of the duct guide 773 may be in contact with or adjacent to an upper surface of the case guide 680. The duct guide 773 may guide air blown from the heat dissipation fan 600. The duct guide 773 may allow air, which is blown from the heat dissipation fan 600, to be evenly distributed to the heat dissipation channels 528 of the heat dissipation sink 520, thereby increasing the heat exchange efficiency of the heat dissipation sink 520.

The fan accommodating space 762 and the sink accommodating space 771 may be located on a horizontal line. The fan accommodating space 762 and the sink accommodating space 771 may be arranged in the left and right directions with respect to the main body 100. The fan accommodating space 762 and the sink accommodating space 771 may be located closer to the rear surface of the main body 100 than the front surface of the main body 100.

In other words, the heat dissipation fan 600 accommodated in the fan accommodating space 762 and the heat dissipation sink 520 accommodated in the sink accommodating space 771 may be positioned on the horizontal line. The heat dissipation fan 600 and the heat dissipation sink 520 may be arranged in the left and right directions with respect to the main body 100. The heat dissipation fan 600 and the heat dissipation sink 520 may be located closer to the rear surface of the main body 100 than to the front surface of the main body 100.

The heat dissipation duct 700 may include an intake duct portion 750 provided to guide air, which is drawn through the outside air intake port 751, to the fan accommodating space 762. Particularly, the heat dissipation duct body 720 may include the intake duct portion 750. The intake duct portion 750 may extend forward from the fan accommodating portion 760. The outside air intake port 751 may be formed on the upper surface of the intake duct portion 750.

An intake space 752 may be formed on the upper surface of the heat dissipation duct body 720. An upper side of the intake space 752 may be formed to be open, and the open upper side of the intake space 752 may be covered by the heat dissipation duct cover 710. The intake space 752 may be formed on the upstream side of the fan accommodating space 762. The intake space 752 may be connected to the fan accommodating space 762 through the fan inlet 761.

The heat dissipation duct 700 may include a first discharge duct portion 780 provided to guide air, which exchanges heat with the heat dissipation sink 520, to the first outside air discharge port 782. Particularly, the heat dissipation duct body 720 may include the first discharge duct portion 780. The first discharge duct portion 780 may extend from the sink accommodating portion 770. For example, the first discharge duct portion 780 may be formed to extend by a predetermined length diagonally from the sink accommodating portion 770 toward one front corner of the main body 100 and then extend forward.

A first discharge space 781 may be formed on the upper surface of the heat dissipation duct body 720. An upper side of the first discharge space 781 may be open, and the open upper side of the first discharge space may be covered by the heat dissipation duct cover 710. The first discharge space 781 may be formed on the downstream side of the sink accommodating space 771.

The heat dissipation duct 700 may include a second discharge duct portion 790 provided to guide air, which exchanges heat with the heat dissipation sink 520, to the second outside air discharge port 794. Particularly, the heat dissipation duct body 720 may include the second discharge duct portion 790. The second discharge duct portion 790 may branch from the first discharge duct portion 780 and extend forward.

A second discharge space 791 may be formed on an upper surface of the second discharge duct portion 790. An upper side of the second discharge space 791 may be open, and the open upper side of the second discharge space 791 may be covered by the heat dissipation duct cover 710. The second discharge space 791 may be formed on the downstream side of the sink accommodating space 771.

As mentioned above, the second discharge duct portion 790 may be formed by branching from the first discharge duct portion 780. Alternatively, the first discharge duct portion 780 and the second discharge duct portion 790 may be formed independently of each other.

Figure 18:
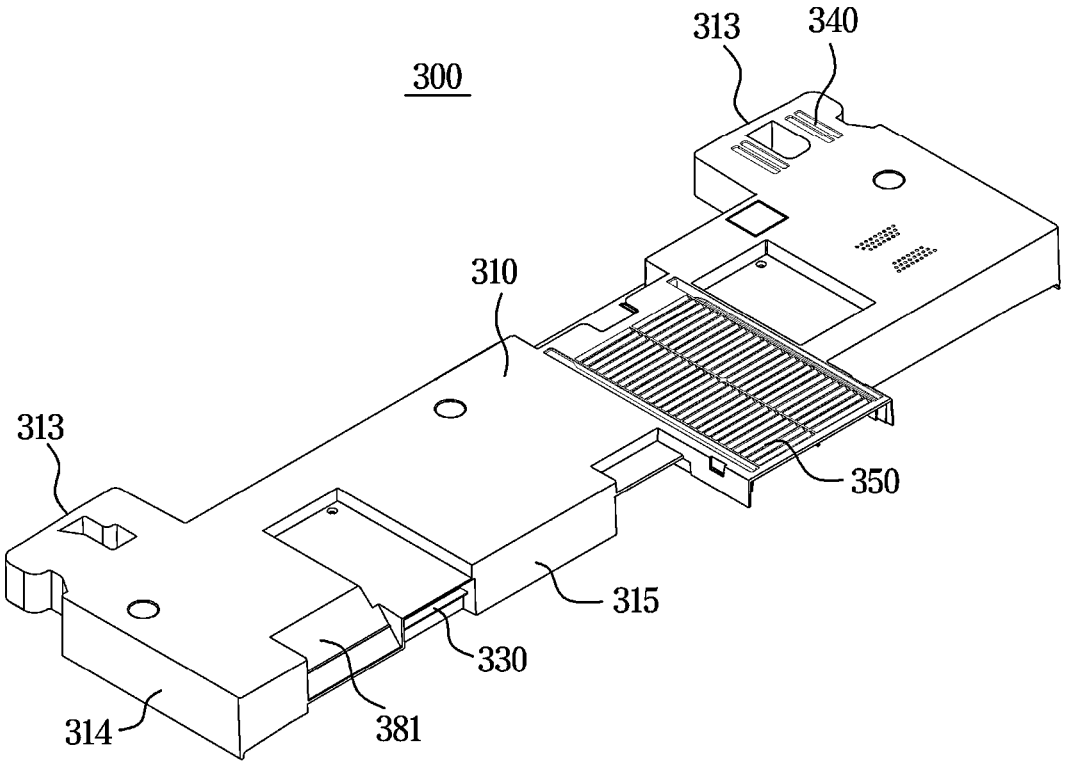
FIG. 18 is a view illustrating the top cover according to one embodiment of the present disclosure.
Figure 19:
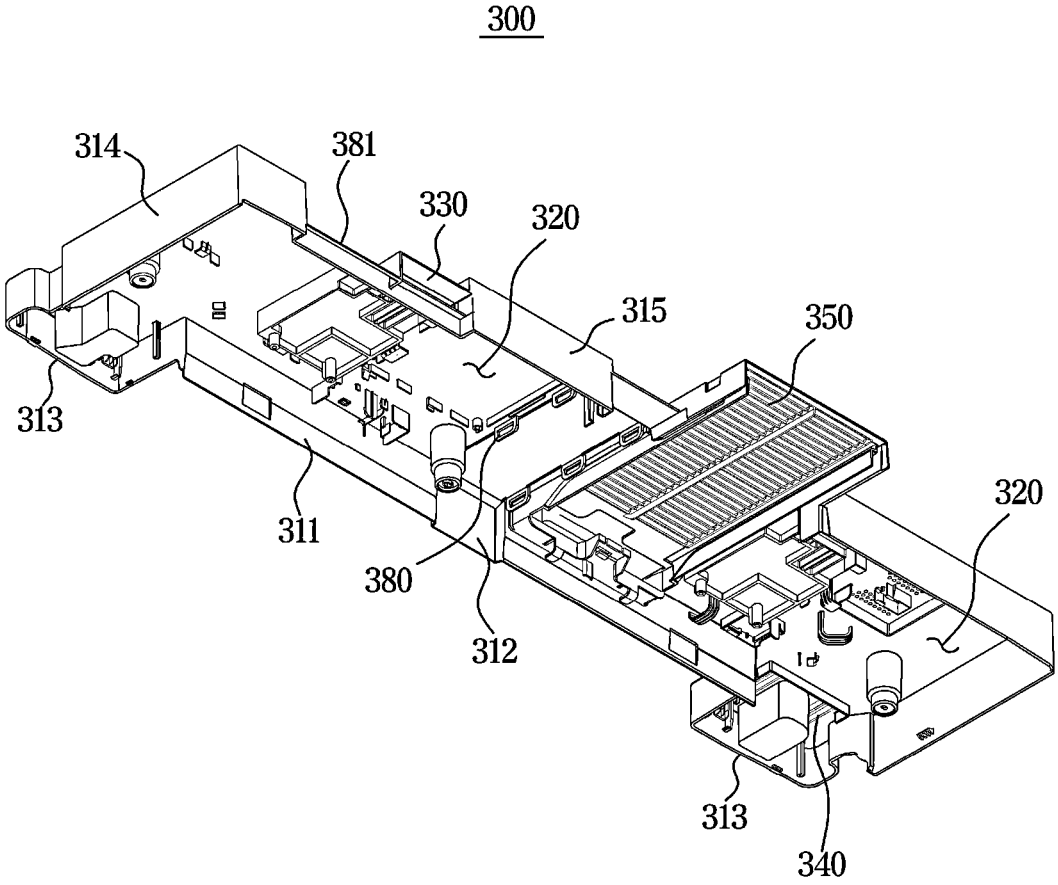
FIG. 19 is a view of a lower surface of the top cover according to one embodiment of the present disclosure.

FIG. 18 is a view illustrating the top cover according to one embodiment of the present disclosure. FIG. 19 is a view illustrating a lower surface of the top cover according to one embodiment of the present disclosure.

As described above, the refrigerator 1 may include the top cover 300 coupled to the front portion of the upper surface of the main body 100 so as to cover the plurality of hinges 31.

The top cover 300 may include a top cover upper surface 310, a top cover front surface 311 extending downward from a front edge of the top cover upper surface 310, a top cover side surface 314 extending downward from a side edge of the top cover upper surface 310, a top cover rear surface 315 extending downward from a rear edge of the top cover upper surface 310, and a top cover inner space 320 formed by the top cover upper surface 310, the top cover front surface 311, the top cover side surface 314, and the top cover rear surface 315. A lower side of the top cover inner space 320 may be open, and the lower side of the top cover inner space 320 may be covered by the upper surface of the upper wall 110.

The top cover 300 may include front protrusions 313 protruding forward from both ends of the top cover so as to cover the plurality of hinges 31.

The top cover 300 may include an intake grille 350 located above the outside air intake port 751. The intake grille 350 may prevent foreign substances from moving into the inside of the heat dissipation duct 700 through the outside air intake port 751, protect a dust filter 390, which will be described later, and guide the air drawn through the outside air intake port 751.

The top cover 300 may be equipped with the dust filter 390 provided to filter out foreign substances. The dust filter 390 may be disposed below the intake grille 350 and configured to filter out fine foreign substances.

The top cover 300 may include a discharge port forming portion 312 formed on the top cover front surface 311 of the top cover 300 to form the second outside air discharge port 794 together with the extension duct 740. The discharge port forming portion 312 may protrude forward from the top cover front surface 311.

At least a portion of the air discharged from the heat dissipation duct 700 through the first outside air discharge port 782 may flow into the top cover inner space 320. That is, air warmed by the heat exchange with the heat dissipation sink 520 may flow into the top cover inner space 320. For this, a top cover inlet 330 may be formed in the top cover 300. The top cover inlet 330 may be formed in the top cover rear surface 315.

The first outside air discharge port 782 may include a top cover outlet 784 provided to guide the air inside the heat dissipation duct 700 into the top cover inner space 320. The top cover outlet 784 may be connected to the top cover inlet 330. Air discharged through the top cover outlet 784 may flow into the top cover inner space 320 through the top cover inlet 330.

The first outside air discharge port 782 may include an external outlet 783 separated from the top cover outlet 784 to discharge air from the heat dissipation duct 700 to the outside of the top cover 300. An outlet grille may be formed at the external outlet 783 to prevent foreign substances from flowing into the inside of the heat dissipation duct 700 through the external outlet 783.

Air flowing into the top cover inner space 320 may pass through the top cover inner space 320 and be discharged to the outside of the top cover 300. For this, the top cover 300 may include a top cover discharge port 340. The top cover discharge port 340 may be formed on the front protrusions 313 of the top cover 300. The top cover discharge port 340 may be formed on the front protrusion 313 that is farther from the top cover inlet 330 among the front protrusions 313. The top cover discharge port 340 may be formed on an upper surface of the front protrusion 313. As the top cover discharge port 340 is formed on the front protrusion 313, the air discharged through the top cover discharge port 340 may be prevented as much as possible from being re-drawn into the outside air intake port 751.

As air, which exchanges heat with the heat dissipation sink 520, passes through the top cover inner space 320, the air may heat the upper surface of the main body 100. Accordingly, it is possible to prevent the dew condensation in the upper portion of the front surface of the main body 100.

The top cover 300 may include a discharge guide portion 381 formed to guide air discharged to the outside of the heat dissipation duct 700 through the external outlet 783 of the first outside air discharge port 782. The discharge guide portion 381 may be formed at an angle on the top cover rear surface 315. The air discharged through the external outlet 783 may be guided to be discharged smoothly without interfering with the top cover 300.

Figure 20:
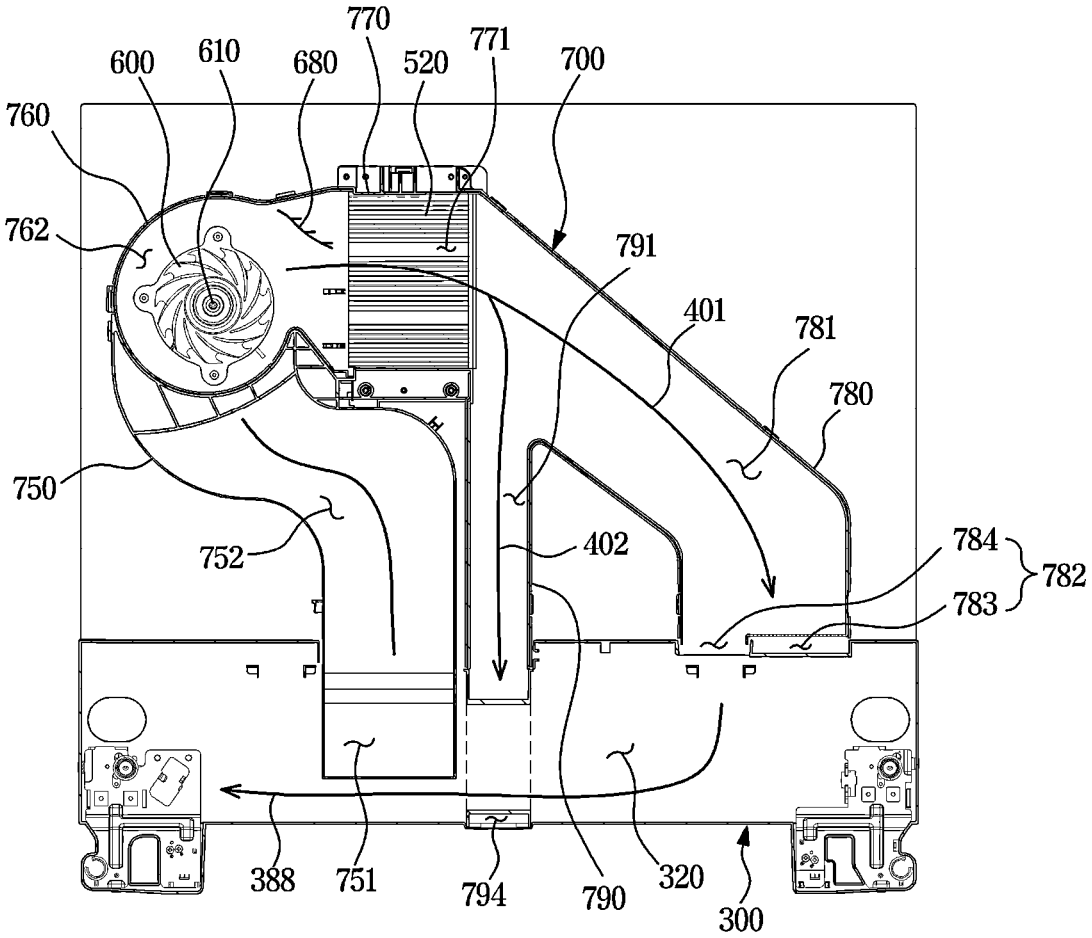
FIG. 20 is a view illustrating a first heat dissipation flow path, a second heat dissipation flow path, and a top cover flow path according to one embodiment of the present disclosure.

FIG. 20 is a view illustrating a first heat dissipation flow path, a second heat dissipation flow path, and a top cover flow path according to one embodiment of the present disclosure.

A first heat dissipation flow path, a second heat dissipation flow path, and a top cover flow path according to one embodiment of the present disclosure will be described with reference to FIG. 20.

By the above-mentioned structure of the heat dissipation duct 700 and the top cover 300, the refrigerator 1 may include the first heat dissipation flow path 401 through which air, which exchanges heat with the heat dissipation sink 520, is discharged to the outside of the main body 100, and the second heat dissipation flow path 402 through which air, which exchanges heat with the heat dissipation sink 520, is discharged toward the rotation bar 40. The second heat dissipation flow path 402 may be formed by branching from the first heat dissipation flow path 401.

The first heat dissipation flow path 401 may be formed by the outside air intake port 751, the intake space 752, the fan inlet 761, the fan accommodating space 762, the sink accommodating space 771, the first discharge space 781 and the first outside air discharge port 782.

The second heat dissipation flow path 402 may be formed by the outside air intake port 751, the intake space 752, the fan inlet 761, the fan accommodating space 762, the sink accommodating space 771, the second discharge space 791 and the second outside air discharge port 794.

The refrigerator 1 may include the top cover flow path 388 through which air, which is discharged through the first heat dissipation flow path 401, flows into the inside of the top cover 300, passes through the inner space 320 of the top cover 300, and then is discharged to the outside of the top cover 300.

The top cover flow path 388 may be connected to an end of the first heat dissipation flow path 401. That is, the top cover flow path 388 may be connected to the top cover outlet 784 of the first outside air discharge port 782.

Figure 21:
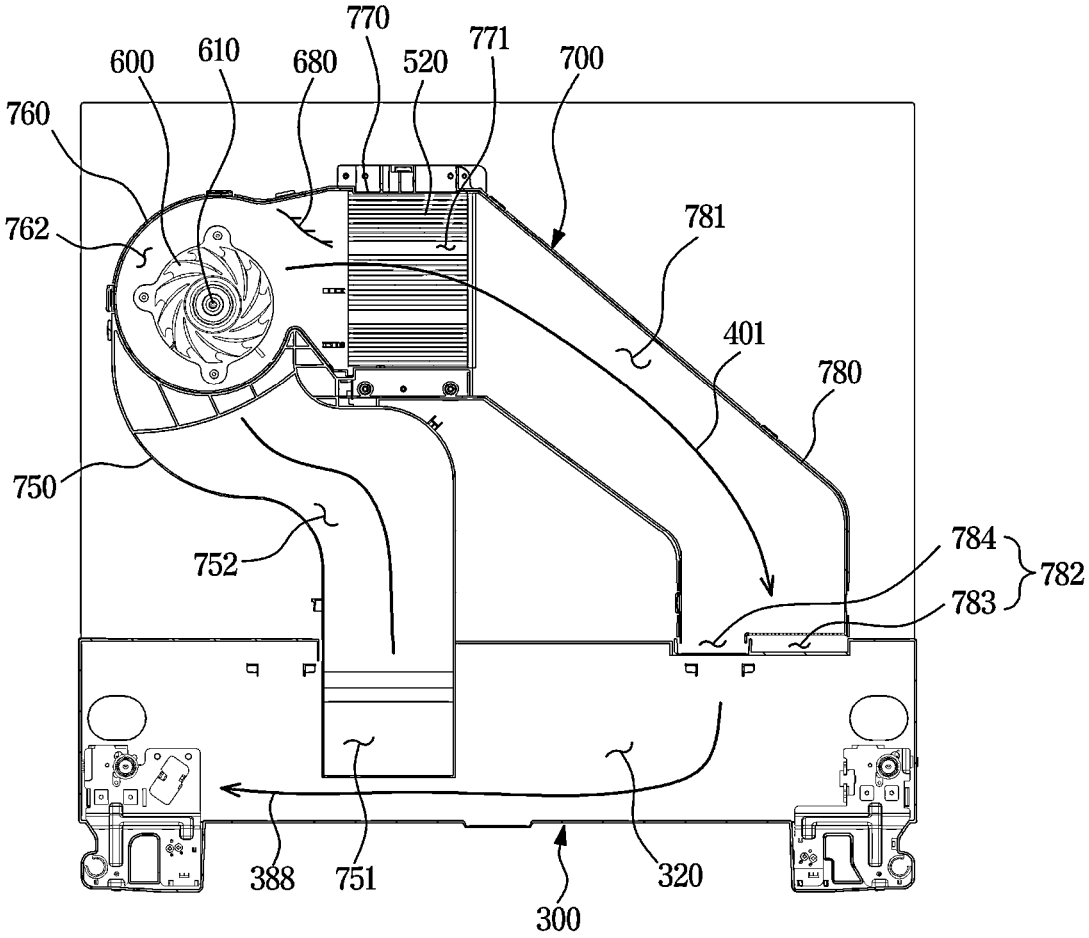
FIG. 21 is a view illustrating the first heat dissipation flow path and the top cover flow path according to one embodiment of the present disclosure.
Figure 22:
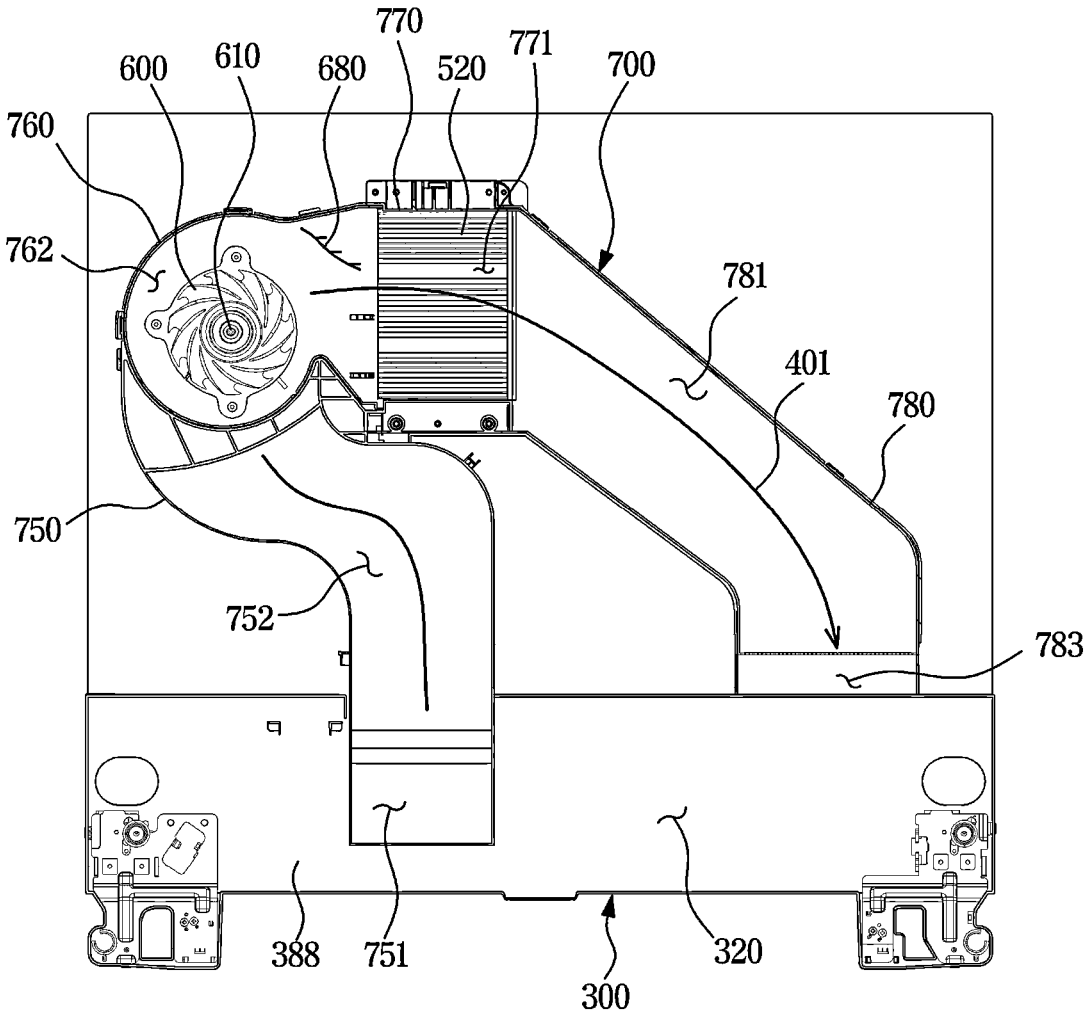
FIG. 22 is a view illustrating the first heat dissipation flow path according to one embodiment of the present disclosure.

FIG. 21 is a view illustrating the first heat dissipation flow path and the top cover flow path according to one embodiment of the present disclosure. FIG. 22 is a view illustrating the first heat dissipation flow path according to one embodiment of the present disclosure.

The above-described second heat dissipation flow path 402 and top cover flow path 388 are not essential and may be omitted according to embodiments.

For example, as shown in FIG. 21, the second heat dissipation flow path 402 may be omitted and the refrigerator may include only the first heat dissipation flow path 401 and the top cover flow path 388. That is, the second discharge duct portion 790 forming the second discharge space 791 may be omitted in the heat dissipation duct 700.

Further, as shown in FIG. 22, both the second heat dissipation flow path 402 and the top cover flow path 388 may be omitted. That is, the second discharge duct portion 790 forming the second discharge space 791 may be omitted in the heat dissipation duct 700, and the first outside air discharge port 782 may be composed of only the external outlet 783. In this case, the air inside the heat dissipation duct 700 may not be discharged to the rotation bar 40 or the inside of the top cover 300, but may be discharged to the outside of the main body 100.

Figure 23:
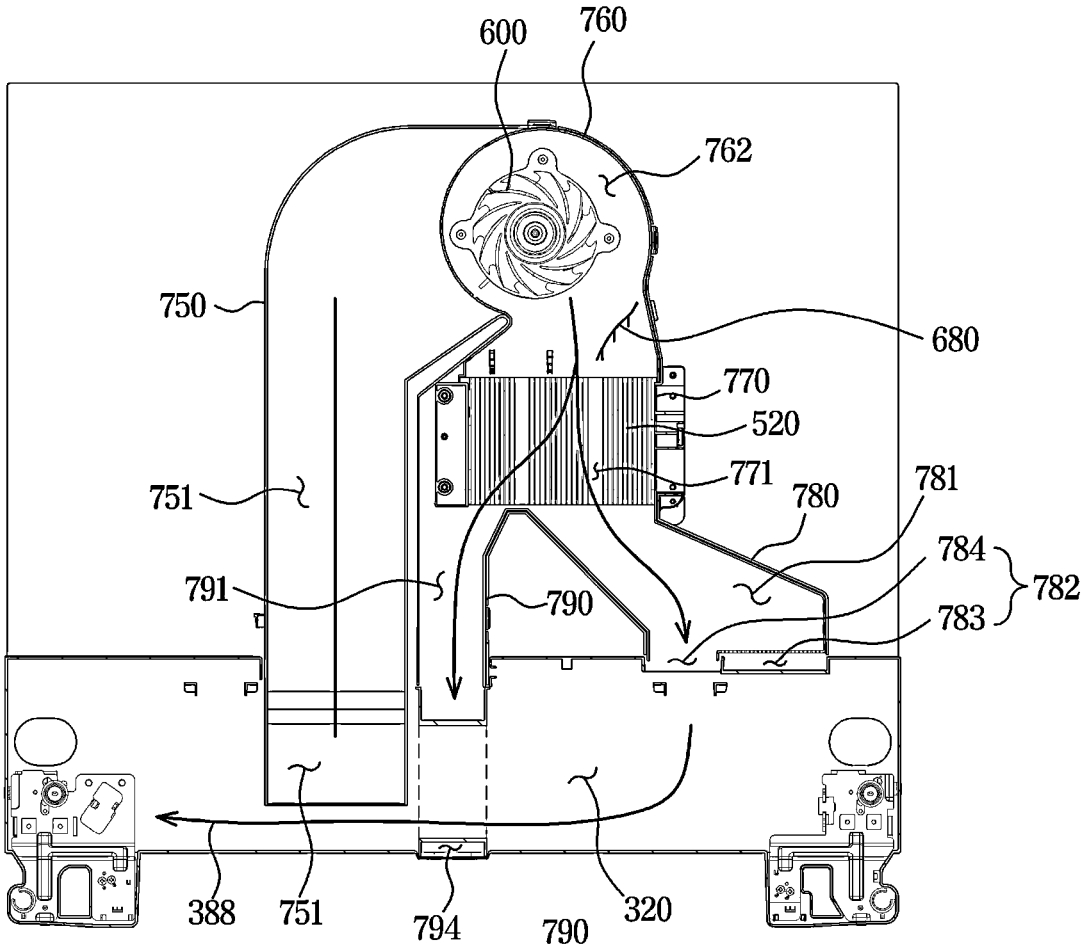
FIG. 23 is a view illustrating a positional relationship between the heat dissipation fan and the heat dissipation sink according to one embodiment of the present disclosure.

FIG. 23 is a view illustrating a positional relationship between the heat dissipation fan and the heat dissipation sink according to one embodiment of the present disclosure.

According to embodiments, the positions of the fan accommodating space 762 and the sink accommodating space 771 of the heat dissipation duct 700 may be changed.

For example, as shown in FIG. 23, the sink accommodating space 771 and the fan accommodating space 762 may be arranged in the front and rear direction with respect to the main body 100. That is, the heat dissipation sink 520 accommodated in the sink accommodating space 771 and the heat dissipation fan 600 accommodated in the fan accommodating space 762 may be arranged in the front and rear direction with respect to the main body 100.

In this case, the heat dissipation sink 520 may be provided to allow the airflow flowing by the heat dissipation fan 600 to flow in a direction parallel to the direction in which the heat dissipation fins 525 extend.

As mentioned above, according to the embodiment of the present disclosure, it is sufficient that the heat dissipation sink 520 and the heat dissipation fan 600 are disposed horizontally to each other on the upper wall 110, and there is no limitation in the position thereof.

As mentioned above, according to the embodiment of the present disclosure, the thermoelectric cooling device 400 may be provided on the upper portion of the main body 100. Even when the refrigerator 1 is installed to allow the rear surface of the main body 100 to be in close contact with the rear wall of an indoor space, the heat dissipation of the thermoelectric cooling device 400 may be performed smoothly. In addition, when the thermoelectric cooling device 400 is provided at the rear of the main body 100, it may not be easy to access the thermoelectric cooling device 400. However, according to one embodiment of the present disclosure, the thermoelectric cooling device 400 may be installed in the upper portion of the main body 100, and thus it may be easy to access the thermoelectric cooling device 400. Accordingly, it is possible to facilitate assembly, disassembly, replacement, and repair of the thermoelectric cooling device 400.

In addition, the cold air generated through the thermoelectric cooling device 400 falls downward due to high density thereof, and the cold air is efficiently transmitted inside the storage compartment by the convection phenomenon, and thus the cooling efficiency of the storage compartment through the thermoelectric cooling device 400 may be improved.

In addition, because the cooling sink 570 is located below the thermoelectric element 530, defrost water generated in the cooling sink 570 may be prevented from penetrating into the thermoelectric element 530 and it is possible to prevent the failure and malfunction of the thermoelectric element 530.

In addition, the heat dissipation fan 600 may be disposed on the upper wall 110 to be located in the horizontal direction of the heat dissipation sink 520, and the cooling fan 800 may be disposed on the upper wall 110 to be located in the horizontal direction of the cooling sink 570. Accordingly, the size of the thermoelectric cooling device may be compact and the reduction of the space of the storage compartment 11 due to installation of the thermoelectric cooling device may be minimized.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator comprising:

a main body;

a storage compartment inside the main body;

a door configured to open and close the storage compartment;

an evaporator configured to evaporate a refrigerant to generate cold air;

an evaporator duct at a rear side of the storage compartment and configured to supply cold air generated by the evaporator to the storage compartment;

a top cover provided to cover a front upper surface of the main body; and a thermoelectric cooling device including;

a thermoelectric element including a heating surface which generates heat and thereby causes air to be heated and a cooling surface which absorbs heat and thereby causes air to be cooled, and a heat dissipation duct disposed on an upper wall of the main body and configured to guide a flow of air to exchange heat with the heating surface, the heat dissipation duct including:

an outside air intake port provided to draw in air from outside of the main body to an inside of the heat dissipation duct, and an outside air discharge port provided to discharge air, which exchanges heat with the heating surface, to the outside of the main body, wherein the thermoelectric cooling device is configured to heat air from an outside of the main body with the heating surface and discharge the air heated by the heating surface to the outside of the main body, and to cool air from the storage compartment with the cooling surface and supply the air cooled by the cooling surface to the storage compartment, and the thermoelectric cooling device is disposed on an upper side of the storage compartment, and at least a portion of the air discharged from the heat dissipation duct through the outside air discharge port is guided into an inner space of the top cover.

2. The refrigerator of claim 1, wherein the heating surface faces above the thermoelectric element and the cooling surface faces below the thermoelectric element.

3. The refrigerator of claim 1, wherein the thermoelectric cooling device includes a heat dissipation sink including:

a heat dissipation sink base which is in contact with the heating surface, and a plurality of heat dissipation fins protruding from the heat dissipation sink base in a first direction which is perpendicular to an upper surface of the heat dissipation sink base.

4. The refrigerator of claim 3, wherein the thermoelectric cooling device includes a heat dissipation fan configured to generate the flow of air in a second direction which is parallel to the upper surface of the heat dissipation sink base and toward the heat dissipation sink.

5. The refrigerator of claim 4, wherein the heat dissipation fan is a centrifugal fan configured to draw air into the centrifugal fan along an axial direction of the centrifugal fan and discharge the flow of air along a radial direction of the centrifugal fan, and the heat dissipation sink is located in the radial direction.

6. The refrigerator of claim 4, wherein the thermoelectric cooling device includes a fan case in which the heat dissipation fan is accommodated, and which guides the flow of air from the heat dissipation fan toward the heat dissipation sink.

7. The refrigerator of claim 6, wherein the fan case includes:

a case bottom on which the heat dissipation fan is rotatably coupled, a case scroll portion extending upward from an edge of the case bottom, and a case guide extending upward from the case bottom and spaced apart from the case scroll portion, and the case bottom, the case scroll portion, and the case guide are configured to guide the flow of air from the heat dissipation fan toward the heat dissipation sink.

8. The refrigerator of claim 7, wherein the case scroll portion includes a downstream end and an upstream end according to a rotation direction of the heat dissipation fan, and a scroll portion opening is between the downstream end and the upstream end and is open toward the heat dissipation sink.

9. The refrigerator of claim 8, wherein the case guide is configured to guide the flow of air toward the upstream end of the case scroll portion.

10. The refrigerator of claim 4, wherein the heat dissipation duct is further configured to guide the flow of air drawn into the heat dissipation duct through the outside air intake port to exchange heat with the heat dissipation sink.

11. The refrigerator of claim 10, wherein the heat dissipation duct includes:

a fan accommodating section that forms a fan accommodating space in which the heat dissipation fan is accommodated, and a sink accommodating section that forms a sink accommodating space in which the heat dissipation sink is accommodated.

12. The refrigerator of claim 11, wherein the fan accommodating space and the sink accommodating space are located on a horizontal line.

13. The refrigerator of claim 11, wherein the heat dissipation duct includes an intake duct portion on an upstream side of the fan accommodating section that forms an intake space to guide air, which is drawn from outside the main body into the heat dissipation duct through the outside air intake port, to the fan accommodating space.

14. The refrigerator of claim 11, wherein the heat dissipation duct includes a discharge duct portion on a downstream side of the sink accommodating section that forms a discharge space to guide air, which exchanges heat with the heat dissipation sink, to the outside air discharge port.

15. The refrigerator of claim 1, wherein the outside air discharge port is configured to discharge the air toward an external space above the main body.

16. The refrigerator of claim 1, wherein the top cover includes a top cover inlet formed in a rear surface of the top cover, and the portion of the air discharged from the heat dissipation duct through the outside air discharge port is guided into the inner space of the top cover through the top cover inlet.

17. The refrigerator of claim 16, wherein the top cover includes a top cover discharge port configured to discharge, to the outside of the top cover, the air that is guided into the inner space of the top cover through the top cover inlet.

18. The refrigerator of claim 17, wherein the refrigerator further comprises a hinge configured to rotatably support the door, and the top cover includes front protrusions protruding forward from an end of the top cover so as to cover the hinge.

19. He refrigerator of claim 18, wherein the top cover discharge port is formed on an upper surface of the front protrusions.

* * * * *